US005846102A

United States Patent [19]

Nitta et al.

[11] Patent Number: 5,846,102

[45] Date of Patent: Dec. 8, 1998

[54] FOUR-CYCLE ENGINE FOR A SMALL JET BOAT

[75] Inventors: Shigemitsu Nitta; Masato Kinoshita, both of Kakogawa, Japan

[73] Assignee: Kawasaki Jukogyo Kabushiki Kaisha, Kobe, Japan

[21] Appl. No.: 712,188

[22] Filed: Sep. 11, 1996

[51] Int. Cl.[6] ..... B63H 21/38

[52] U.S. Cl. ..... 440/1; 60/323; 123/196 AB; 123/198 DC; 184/106; 440/88; 440/89; 440/111

[58] Field of Search ..... 440/1, 84, 88, 440/89, 111, 75; 184/104.3, 6.22, 106; 123/195 C, 196 R, 196 AB, 198 DC; 114/270; 60/321, 323

[56] References Cited

U.S. PATENT DOCUMENTS

| | | | |
|---|---|---|---|
| 4,150,655 | 4/1979 | Gaggiano et al. | 184/104.3 |
| 4,628,878 | 12/1986 | Nakano et al. | 123/196 R |
| 4,674,457 | 6/1987 | Berger et al. | 123/196 R |
| 4,800,719 | 1/1989 | Campbell | 60/323 |
| 5,033,428 | 7/1991 | Sasaki | 123/198 DC |
| 5,109,668 | 5/1992 | Lindstedt | 60/323 X |
| 5,237,950 | 8/1993 | Abe et al. | 114/270 |
| 5,558,549 | 9/1996 | Nakase et al. | 114/270 |
| 5,647,779 | 7/1997 | Nanami | 440/111 |

FOREIGN PATENT DOCUMENTS

| | | |
|---|---|---|
| 3-61152 | 6/1991 | Japan . |

*Primary Examiner*—Sherman Basinger
*Attorney, Agent, or Firm*—Marshall, O'Toole, Gerstein, Murray & Borun

[57] ABSTRACT

A four-cycle engine is provided which is suitable for use in a vehicle or an apparatus such as a small jet boat to be operated on the premise that it often overturns, and which is simple in structure. An oil pan 22 is disposed below the bottom of a crankcase 13, the spaces in the components are communicated with each other via a communicating hole 27 which is formed in the bottom of the crankcase 13, and a cylindrical peripheral wall 26 which is downwardly extending from the bottom of the crankcase 13 toward the oil pan 22 is formed around the communicating hole 27 and is spacially separated from the side wall of the oil pan 22 by a distance.

15 Claims, 15 Drawing Sheets

X
49a
49b
59
58
49
61
60
16b
57
42
55
56
47
48
43b
43
43a
44
46a
46b
46
66
50b
45
62
63
52,53
46b
50c
50
52 , 53
41
64
65
50a
b
45
50d
S
50
52
54
53
46c
50a
46b
51
51a
45a
45b

FOUR-CYCLE ENGINE FOR A SMALL JET BOAT

BACKGROUND OF THE INVENTION

The invention relates to a four-cycle engine which is preferably used in a small jet boat or the like, and also to a small jet boat on which such a four-cycle engine is mounted.

A small jet boat is a recreational watercraft for one or two riders which glides over water during use.

A jet boat uses a water jet pump or a screw propeller as the propulsion means. Conventionally, a two-cycle engine is mounted as an engine for driving the propulsion means because a two-cycle engine is small in size and weight and has a lubrication system which is suitable for a small jet boat. Specifically, in a two-cycle engine, lubrication is done by the drysump system in which lubricating oil is not accumulated in a crankcase. A small jet boat is a vehicle characterized in that the boat often overturns (or capsizes), the operator or another person raises the boat each time when it overturns, and the operator then desirably continues to enjoy the gliding action over water. Consequently, it is preferred to use a drysump system in which, even when the boat overturns, no lubricating oil enters from the crankcase into a combustion chamber.

Such an engine is mounted together with suction and exhaust devices in a space surrounded by so-called shell plating of a hull, such as a bottom hull, a hood, and a seat. This configuration is adopted because of the following reasons. If the engine, etc. are protruding below the bottom hull, the boat cannot smoothly glide over the water. If the engine, etc. are protruding above or to the side of the hood or the seat, water can be directly splashed on the engine, etc., thereby impeding normal combustion and causing the engine, etc. to easily rust, and making it difficult for a person to go on board the boat. In a small jet boat, however, the space (i.e., the engine compartment) for containing an engine is usually restricted in size to a considerably small volume because of the following reasons. If the engine compartment has a large volume, the small jet boat itself is large in size so that operation properties peculiar to such a boat, such as speed and turning characteristics are apt to be impaired. In a small jet boat, generally, a seat has a trapezoidal section shape which is extended in the lower side, so that a person easily sits astride the seat. If the seat is enlarged in width, it is difficult for a person to sit astride the seat.

Because of these reasons, conventionally, a two-cycle engine is used as a propulsion engine for a small jet boat. Since a two-cycle engine does not require an oil pan, a valve, a valve operating mechanism, and the like, the engine is compact in size. Furthermore, a two-cycle engine provides a high power output because of its high explosion frequency. Consequently, a two-cycle engine is very suitable for a small jet boat.

In contrast, a normal four-cycle engine employs a wetsump lubrication system in which lubricating oil is accumulated in a crankcase. If a boat overturns with a normal four-cycle engine, therefore, lubricating oil enters a combustion chamber via a gap between a cylinder and a piston. When such entrance of lubricating oil into a combustion chamber occurs, exhaust gases contain white smoke and, in many cases, the engine stalls and is hard to restart. In the prior art, therefore, a four-cycle engine is not used in a small jet boat.

An example of a small jet boat on which a two-cycle engine is mounted is disclosed in, for example, Japanese Utility Model Publication (Kokai) No. HEI 3-61152.

In considering noise reduction and the prevention of air pollution, recently, the availability of a four-cycle engine for a small jet boat or the like has begun to be desired.

In order to use a four-cycle engine in a small jet boat or the like, however, it is required to solve the above-discussed problems concerning lubricating oil in the case of turnover of a small jet boat or the like and concerning a small housing space.

If a prior art four-cycle engine of the wetsump system is used in a small jet boat, lubricating oil undesirably enters from a crankcase into a combustion chamber in the case of turnover. A four-cycle engine of the drysump system maybe employed to meet this problem, however, the engine is considerably complicated in structure because of the following reason. In the drysump system, lubricating oil is not accumulated in a crankcase. Consequently, it is necessary to separately provide an oil tank and a lubricating oil recovery pump which sucks lubricating oil from the crankcase and feeds it to the tank. Furthermore, a lubrication system (a filter, a pressure pump, pipes, etc.) is configured for supplying lubricating oil from the tank to various portions. As seen from the above, unlike a two-cycle engine in which a drysump system is inevitably employed because of the inherent feature that a sucked air-fuel mixture is pressurized in a crankcase, the employment of a drysump system a four-cycle engine, which has more complicated structure, is very disadvantageous from a practical view point.

Furthermore, a four-cycle engine is larger in size than a two-cycle engine of the same output power. When a four-cycle engine is to be mounted as a propulsion engine on a small jet boat, therefore, there arise problems regarding the location of the hull where the engine is to be placed and regarding the manner of mounting the engine. Such problems cannot be easily solved because of the reasons discussed below.

(1) In the same manner as the case where a two-cycle engine is mounted, the engine compartment of a small jet boat is restricted in size. In a small jet boat of the type in which a person sits astride a seat, particularly, the width of the seat is limited by body dimensions of a rider and hence also the engine compartment under the seat has a very small width.

(2) As described above, a shape of the engine compartment is similar to that of said seat and is a trapezoidal section shape which is extended in the lower side thereof.

In addition to the fact that the top part of a four-cycle engine is larger in size than that of a two-cycle engine, there is a restriction that suction devices such as an intake silencer and a carburetor must be placed in positional relationships (same as those in the case of a two-cycle engine) with respect to the engine in which certain conditions are satisfied and the devices are not separated from the engine by a large distance. Therefore, the suction devices of a four-cycle engine, must be compactly housed in the engine compartment adjacent to the engine.

A four-cycle engine has a large size because of the reasons including: first, intake and exhaust valves (poppet valves) are provided and hence a large space is inevitably formed above a cylinder; second, a space for an oil pan is required in a wetsump lubrication system in which lubricating oil is accumulated in a crankcase in the same manner as a usual four-cycle engine; and third, a four-cycle engine is lower in explosion frequency than a two-cycle engine and hence the number of cylinders and the displacement must be increased in order to attain the same output power. Suction devices must be connected to an engine in a substantially integrated manner because of the following reasons. For efficiency, such devices (particularly, a carburetor) should be placed above a cylinder so that fuel particles smoothly enter the combustion chamber without going against gravity. In order to reduce the suction resistance, the devices should be disposed in the vicinity of a cylinder.

(3) Since a four-cycle engine is larger also in weight than a two-cycle engine, the weight distribution in a small jet boat must be considered with particular attention. In order to attain balance and stability in a small jet boat, an engine must be placed at a desirable position in the longitudinal and transverse directions of the hull. Generally, a space in which an engine can be mounted is narrow in the width (transverse) direction, and the location of an engine therefore is particularly restricted in that direction. Therefore, it is not easy to properly position an engine so as to balance the weight of the engine in the transverse directions of the hull.

(4) In propulsion means for a small jet boat, such as a water jet pump or a screw propeller, the drive shaft is disposed in the vicinity of the bottom of the hull. In contrast, since a four-cycle engine requires an oil pan, the crank shaft of the engine is at a position higher than that of a two-cycle engine (an upward position separated from the lowest portion of the engine). Depending on the quantity of lubricating oil which is to be stored in the oil pan, and the shapes of the oil pan and the crankcase, this may require that the crank shaft is disposed at so high position that the crankshaft can hardly be connected with the drive shaft at the appropriate point, and/or that the drive shaft must be unreasonably angled.

SUMMARY OF THE INVENTION

It is an object of the invention to provide a four-cycle engine with a wetsump lubrication system which can be readily constructed, and which is suitable for use in a vehicle or an apparatus such as a small jet boat which may often overturn.

It is another object of the invention to provide a small jet boat in which such a four-cycle engine is mounted in a small space in a suitable arrangement.

The four-cycle engine of the invention is configured in the following manner.

a) An oil pan is disposed below a crankcase so that the bottom of the crankcase projects toward the inner space of the oil pan, and the inner space of the crankcase is fluidly communicated with that of the oil pan via a communicating hole which is formed in the bottom of the crankcase. In a four-cycle engine, it is usual to form an oil pan below a crankcase. However, the oil pan defined above is of the closed type isolated from the inner space of a crankcase and is not configured as a mere tray-like structure which is provided below a crankcase and has an inner space in common with the crankcase.

The engine is further configured in the following manner.

b) It is preferable that a peripheral wall is provided which protrudes downward from the bottom of the crankcase toward the oil pan and is formed around the communicating hole, and the peripheral wall is spacially separated from the side wall of the oil pan.

An alternative engine of the present invention is configured in the following manner.

c) An oil pan is provided below a crankcase, an inner space of the crankcase is communicated with an inner space of the oil pan through a communicating pipe and the communicating pipe is projecting downwardly into the oil pan leaving a distance from a side wall of the oil pan.

d) It is preferable that a tunnel for a timing chain is provided on one side end of said crankcase, said tunnel is communicated with the inner space of the oil pan via a communicating path formed at the bottom of the crankcase and said communicating pipe projects downwardly into the inner space of the oil pan, so that the inner space of the crankcase fluidly communicates with said communicating path through a hole formed in the bottom of the crankcase.

When used in a small planning boat or the like, the four-cycle engine of the invention having the above-mentioned configuration can perform the following functions.

Because an oil pan is disposed below the bottom of a crankcase having a communicating hole as described in a) above, and lubricating oil is accumulated in the oil pan, provision for lubrication does not particularly complicate the construction of said four-cycle engine the same as the construction of a four-cycle engine of the prior art.

Specifically, lubricating oil which has lubricated required portions of the engine naturally falls under the influence of gravity via the crankcase into the oil pan below the crankcase. Unlike the drysump system, therefore, it is not necessary to separately provide an oil tank and a recovery pump or the like for feeding lubricating oil to the tank. Furthermore, a special lubricating device is not required.

In this engine, lubricating oil accumulated in the oil pan is essentially prevented from entering the combustion chamber, even when, for example, a small jet boat is caused to fall into a lateral turnover state or a 180 degree inversion state (hereinafter, referred to as "inversion"). The communicating hole connecting the crankcase with the oil pan is formed in the bottom of the crankcase which projects toward the oil pan, and the position of the communicating hole is spacially separated from the side wall of the oil pan. Thus, when the engine has fallen into a lateral turnover state or the like, lubricating oil in the oil pan moves along the side wall of the oil pan and is then accumulated on the side wall. Therefore, the lubricating oil is prevented from entering the crankcase via the communicating hole, unless the depth of the oil in the oil pan is greater than the spacial distance between the side wall and the communicating hole.

In the engine wherein the peripheral wall of the communicating hole downwardly protrudes toward the oil pan (the engine of b) above), even when the engine overturns upside down, lubricating oil is accumulated around the protruded peripheral wall and hence the oil does not enter the crankcase. In other words, lubricating oil in the oil pan is prevented from returning into the crankcase via the communicating hole unless the depth of the oil in the inversion state exceeds the protrusion length of the peripheral wall.

Since lubricating oil does not enter the crankcase from the oil pan as described above, the oil is prevented from reaching the combustion chamber via a gap between a cylinder and a piston. From the above, the distance between the peripheral wall of the communicating hole and the side wall of the oil pan, and the downward protrusion length of the peripheral wall can be suitably determined in accordance with the quantity of lubricating oil, the shapes of the oil pan and the crankcase, and the like. Even in the case where there is a possibility that a small quantity of lubricating oil may return into the crankcase depending on, for example, the direction in which the engine overturns, the oil is easily prevented from entering the combustion chamber from the oil pan by simple means because the quantity of the returning oil is small.

Also, the four-cycle engine described in c) is lubricated by the wetsump system and has the same advantage as that of the engine described in b). The advantage is that a lubricating oil accumulated in the oil pan is essentially prevented from flowing into the combustion chamber even if the small jet boat overturns.

Such flow of the oil is prevented from occurring because the space exists around the communicating pipe. When the engine laterally overturns, the oil is accumulated in the space and scarcely reaches to the inner space of the crankcase through the communicating pipe. Therefore, the oil does not flow toward the combustion chamber.

In the engine having the communicating path as described in d), if the oil may enter the communicating path through the communicating pipe, there is no possibility that the oil reaches the combustion chamber, because of the following reasons.

First, the oil which reaches the communicating path is not the whole of the oil in the oil pan but a small quantity.

Second, since the hole for allowing the return oil to drip into the oil pan is formed at the bottom of the crankcase, oil which enters the communicating path from the communicating pipe reaches the tunnel disposed for the timing chain. This causes lubricating oil to hardly enter the inner space of crankcase.

e) It is preferable that a switch (so-called turnover switch) is provided in the above-mentioned engine for automatically stopping the engine when the engine is in a turnover (lateral turnover or inversion) state. It is a matter of course that, when the engine is stopped, also the pressure pump for lubricating oil is stopped.

According to the four-cycle engine having the switch described above, when a small jet boat or the like on which the engine is mounted overturns, the switch operates so that the engine and a lubricating oil pressure pump are automatically stopped. When they are automatically stopped in a turnover state, lubricating oil which is supplied to, for example, a bearing for the crank shaft is prevented from dripping down toward a cylinder (combustion chamber). Furthermore, air suction of the pressure pump which may be caused by movement of the oil in the oil pan is prevented.

f) Furthermore, the engine is preferably provided with a water jacket for cooling in the oil pan thereof.

In a normal four-cycle engine which is mounted on an automobile or the like, an oil pan is not particularly subjected to water-cooling and is normally cooled only by means of air-cooling due to the wind caused by the traveling of the automobile. In contrast, in the four-cycle engine of the invention wherein, a water jacket is formed in an oil pan and cooling water is passed through the water jacket, it is not required to expose the outer face of the oil pan to the wind, and hence the engine can be easily placed at an inner position of an enclosed space. Consequently, the engine can be suitably mounted on a vehicle or the like in which an engine is preferably disposed in an enclosed space, such as a small jet boat in which an engine must be placed in a space surrounded by a bottom hull and a hood.

The small jet boat of the invention is a boat in which a four-cycle engine described above is mounted in a space surrounded by shell plating of a hull, and g) the four-cycle engine is mounted in such a manner that a crank shaft is directed in the longitudinal direction of the hull, or in so-called longitudinal placement, and positioned at a substantially center position in the width direction of the hull and all cylinders thereof are slanted in the same direction to left or right sides of the hull, and suction devices are placed in a side opposite to the slanted side.

According to the small jet boat of the invention having the above-mentioned configuration, a four-cycle engine and the like can be suitably placed in a space of a small capacity surrounded by a bottom hull, a hood, a seat, etc. as described below.

A four-cycle engine and suction devices to be attached thereto can be compactly housed in the space of the hull which is restricted particularly in the width dimension, while the suction devices are adjacent to the engine. Because, when the four-cycle engine is placed in such a manner that a crank shaft is directed in the longitudinal direction of the hull and positioned at a substantially center position in the width direction of the hull and all cylinders which upward elongate from the position of the crank shaft are slanted in the same direction and to one of the left and right sides as described in g) above, it is possible, in spite of its tall height, to secure a space in which suction devices can be placed, in the side opposite to the slanted side. On the other hand, if the cylinders are vertically directed, the space in the hull is transversely divided into two portions by the tall cylinders, without leaving a sufficient space in which suction devices can be placed. Since the cylinders are slanted and suction devices are placed in a space adjacent to the cylinders, the conditions that suction devices such as a carburetor are placed above and near the cylinders can be easily satisfied. Generally, the space surrounded by shell plating of the hull and serving as the engine compartment is extended in the longitudinal direction of the hull. Therefore, in the longitudinal direction of the hull, the position where the engine is to be placed can be determined in a relatively arbitrary manner.

Even though the cylinders are slanted as described above, the deviation of the weight of the engine in the direction toward the side is small or limited to a degree which can be corrected by adequately placing suction devices or the like. This is enabled because of the following reason. The engine is arranged so that the position of the crank shaft is at a substantially center position in the width of the hull as described in g) above. Although the crank shaft is placed at such a position, the placement of the suction devices is not obstructed as far as the cylinders above the crank shaft are deviated one of the left and right sides. Since the space serving as the engine compartment is usually extended in the longitudinal direction of the hull as described above, in the view point of weight distribution in the longitudinal direction, the position where the engine is to be placed can be adequately determined in the longitudinal direction of the hull in a relatively arbitrary manner.

Unlike the suction devices which must be disposed above the engine, exhaust devices such as a muffler may be placed at any position in a vertical direction. If there is a sufficient space on the side of the engine or below the slanted cylinders, a hull shape and width of the seat is restricted. Therefore, the exhaust devices may be disposed in the space. However, a four-cycle engine is large as described above and the shape of the hull and the width of the seat are restricted, and hence it is seldom for a small jet boat to have a sufficiently large space at the side of the engine or below the slanted cylinders.

It is preferable that exhaust devices of said small jet boat comprise the following exhaust pipes and a muffler is arranged at the rearward of the engine.

h) Said four-cycle engine comprises a plurality of cylinders, exhaust pipes respectively connected to exhaust ports of a cylinder head provided on top of cylinders are substantially equal in length to each other, end portions of said exhaust pipes are gradually combined into a common exhaust outlet, and all of said exhaust pipes are integrally molded by casting.

Consequently, as compared with the configuration such as that in an exhaust device for an automobile engine in which exhaust pipes formed by sheet metal working are independently separated from each other, at least the space between adjacent exhaust pipes can be eliminated and pipe walls of adjacent exhaust pipes can be commonly used so that the exhaust device can be compactly configured.

The four-cycle engine can sufficiently derive its performance because of the following reason. According to the configuration described in h) above, all the exhaust pipes are equal in length to each other. Therefore, exhaust gasses from the exhaust ports of the cylinder head have a uniform pressure so that each cylinder has substantially uniform power output, thereby the total output power of the engine is increased and the performance of the engine is improved.

i) Said four-cycle engine is an in-line four-cylinder engine, all of said exhaust pipes are integrally formed in such a manner that four exhaust pipes are respectively elongated from said exhaust ports in a direction which is opposite to a direction of said common exhaust outlet, gently bent to gradually change directions of said exhaust pipes to the direction of said common exhaust outlet, and thereafter elongated into a linear form, and said end portions of said exhaust pipes are disposed so as to be vertically and horizontally symmetrical with respect to a center point of said exhaust outlet, and the length of the whole of said exhaust pipes (which are integrally molded, except said common exhaust outlet) is substantially equal to the length of said four-cycle engine.

Consequently, the exhaust pipes can be extended to the maximum in the restricted range, there is little possibility of exhaust interference, and exhaust gasses can smoothly flow to reduce the output loss of the engine. Furthermore, the four exhaust pipes can be compactly configured, and, according to the configuration described in i) above, the four exhaust pipes can be disposed adjacent to and in parallel with the engine body. Consequently, the exhaust pipes can be easily disposed in the space which is restricted in accordance with the length of the engine.

j) Furthermore, a whole of said exhaust pipes is surrounded by a water jacket housing, and cooling water is passed through said water jacket housing, thereby cooling said exhaust pipes.

Consequently, the whole of the exhaust pipes is cooled by cooling water, and hence the temperature rise of the exhaust pipes which are exposed to exhaust gasses of a high temperature are suppressed enough to enable arranging the exhaust pipe adjacent to the engine. The water jacket housing is required only to cover the whole of the exhaust pipes, and hence its structure can be very simplified. Since the water jacket housing is disposed adjacent to the engine body, particularly, cooling water for cooling the engine can be easily introduced into the water jacket housing.

In this configuration, when the transverse slant angle of the cylinders in the engine is adequately set, maintenance in the vicinity of the cylinder head, such as replacement of ignition plugs can be easily done. This arrangement is reasonable also in consideration of the facts that the space to serve as the engine compartment is usually extended in the longitudinal direction of the hull and that exhaust gasses of an engine are preferably directed toward the aft side of a small jet boat.

Furthermore, the small jet boat is preferably configured in the following manner.

k) It is preferable that the drive shaft of the propulsion means is connected to the crank shaft via a pair of gears because of the following reason.

When there is a difference between the position of the crank shaft and the position of the drive shaft in vertical direction, the pair of gears disposed as described in k) above connects the shafts to each other so as to eliminate the level difference. As described above, the drive shaft of propulsion means is usually disposed in the vicinity of the bottom of the hull, and the crank shaft of a four-cycle engine having an oil pan is at a position slightly higher than that of a two-cycle engine. Depending on the quantity of lubricating oil, the shapes of the oil pan and the crankcase, and the like, there may arise a case where the crank shaft is too high in position so as not to be directly connected to the drive shaft. In such a case, when the crank shaft and the drive shaft are connected to each other via a pair of gears vertically arranged, the drive shaft of the propulsion means can be placed in the vicinity of the hull bottom irrespective of the position of the crank shaft without significantly tilting the drive shaft. Each shaft is adequately positioned and then connected to each other via a pair of gears of an appropriate gear ratio, thereby producing an advantage in that the revolution speed of the crank shaft at the maximum output power of the engine can be converted to that which is suitable for the drive shaft of the propulsion means so that the efficiency or so-called matching of the revolution speed can be attained. In place of the pair of gears, a belt, a chain, or the like may be used as the power transmission means between the crank shaft and the drive shaft. In view of a large torque to be transmitted and a high revolution speed, however, the use of a pair of gears is optimum.

The other small jet boat of the invention is a boat in which a four-cycle engine is mounted in a space surrounded by shell plating of a hull, and has features different from the above described small jet boat as follows:

1) The four-cycle engine is mounted in such a manner that the crank shaft is directed in the transverse direction of the hull, and the crank shaft is connected via a pair of bevel gears and another pair of gears to the propulsion means which is rearward disposed; and all cylinders of the four-cycle engine are slanted in the same direction and to one of the fore and aft sides of the hull, and suction or exhaust devices are disposed above the engine including the slanted cylinders.

In the small jet boat having the construction described above, the four-cycle engine is mounted in such a manner that the crank shaft is directed in the transverse direction of the hull (therefore, the cylinders also are arranged in the transverse direction) or in so-called transverse placement, and hence suction devices are not required to be disposed in a small space on the right or left side of and adjacent to the engine (in the transverse direction of the hull) but allowed to be disposed at a position opposing the transverse arrangement of the cylinders. Consequently, it is sufficient for the engine compartment to have a width suitable for transversely placing the four-cycle engine. As described above, the space serving as the engine compartment is extended in the longitudinal direction of the hull. Therefore, suction and exhaust devices can be placed before or behind the cylinder arrangement plane of the transversely placed engine in a relatively easy manner.

Said transverse placement of the four-cycle engine is suitable also for weight distribution because of the following reasons. The four-cycle engine is not required to be shifted to the right or left side of the hull in consideration of the suction devices and the like. Since the space serving as the engine compartment is usually extended in the longitudinal direction of the hull, the position in the longitudinal direction where the engine is to be placed can be determined in a relatively arbitrary manner.

Even though the engine is transversely placed and the crank shaft is directed in the transverse direction of the hull, the revolution of the crank shaft is smoothly transmitted to the propulsion means disposed aft because the pair of bevel gears conducts the power transmission from the crank shaft to the drive shaft of the propulsion means which is placed substantially perpendicular to the crank shaft. Since the power transmission toward the aft side can be conducted as described above, conventional means such as a water jet pump and a screw propeller can be used as the propulsion means.

As described in 1) above, all cylinders of the four-cycle engine are slanted so that the height of the engine is suppressed. Therefore, the height of the center of gravity of the whole of the small jet boat is reduced and the stability of the boat can be improved.

Suction or exhaust devices are placed above the engine which is reduced in height by longitudinally slanting the cylinders, as described in 1) above. Consequently, the space which is necessary in the longitudinal direction of the hull as the engine compartment is not substantially expanded. If cylinders are vertically directed and suction and exhaust devices are respectively placed before and behind the cylinders, the space for housing the devices are prolonged in the longitudinal direction.

m) The small jet boat is shown by the following configuration that; all cylinders of the four-cycle engine are slanted to the aft side of the hull, suction devices are disposed above the cylinders, and exhaust devices are disposed at a position of the hull which is more rearward than the four-cycle engine.

Thereby, the suction devices above the engine are located at a forward and obliquely upper position with respect to the cylinders, the above-mentioned condition that a carburetor and the like are placed above and near the cylinders is easily satisfied.

The passageways which elongate from the suction system to the cylinder head and from the cylinder head to the exhaust system on the rear side can be set in one direction from the fore side to the aft side so as to be simplified. Furthermore, gasses can pass through the passageways more smoothly.

The disposition of the exhaust devices on the aft side is reasonable also in consideration of the facts that exhaust devices are free from the above-mentioned positional restrictions imposed on the suction devices and that exhaust of an engine is preferably directed toward the rear of a small jet boat.

Furthermore, the small jet boat is preferably configured in the following manner.

n) The crank shaft is connected to the propulsion means (a drive shaft of the propulsion means) via the pair of bevel gears, another pair of gears, and a transmission shaft which is directed rearward and disposed below the crank shaft.

According to the small jet boat, furthermore, the crank shaft of the mounted four-cycle engine can be always connected to the drive shaft of the propulsion means in a preferable manner because, when there is a difference in level between the crank shaft and the drive shaft, the crank shaft and the drive shaft can be connected with each other so as to eliminate the level difference. As described above, the drive shaft of propulsion means is usually disposed in the vicinity of the bottom of a hull, and the crank shaft of a four-cycle engine having an oil pan is at a position slightly higher than that of a two-cycle engine. In contrast, in the small jet boat, the rotation of the crank shaft is transmitted to the transmission shaft which is directed longitudinally and disposed below the crank shaft (i.e., placed so as to be easily connected to the drive shaft of the propulsion means), by a pair of bevel gears and the other pair of gears, and the transmission shaft is connected to the drive shaft of the propulsion means.

When the gear ratios of the pair of bevel gears and the other pair of gears are appropriately set, the power transmission can be conducted while the revolution speed of the crank shaft at the maximum output power of the engine is converted to that which is suitable for the drive shaft of the propulsion means so that the efficiency, or so-called matching of the revolution speed can be attained.

The four-cycle engine of the invention having features described above is very suitable for a vehicle or apparatus such as a small jet boat which is to be designed on the premise that it often overturns, because of the following reasons.

1) Since lubrication is conducted by the wetsump system, provision for lubrication does not particularly complicate the configuration thereof compared with a prior art normal four-cycle engine. Therefore, the engine has advantages in that it can be easily constructed, that it is compact in size and the space for installation is small, and that the production cost is low.

2) Even when a small jet boat or the like on which the four-cycle engine is mounted overturns, lubricating oil in an oil pan does not enter a combustion chamber and hence the engine can be smoothly restarted after the boat is returned to the original state.

When the small jet boat or the like overturns, the switch (turnover switch) operates so that the engine and a lubricating oil pressure pump are automatically stopped. Consequently, it is further preferable considering 2) above.

In the four-cycle engine of the invention, a water jacket is formed in an oil pan and hence the oil pan is not required to be air-cooled. Therefore, the engine can be placed freely so as to be suitable for various purposes such as a small jet boat in which an engine must be disposed in an enclosed space.

In the small jet boat having a four-cycle engine mounted in longitudinal placement, a four-cycle engine which is advantageous in, for example, cleanliness of exhaust gasses but considerably larger than a two-cycle engine can be adequately placed in a small space surrounded by shell plating of the hull in the following manners.

1) The space for placing suction devices is secured by slanting all cylinders of the engine in the same direction and to one of the left and right sides of the hull. In spite of the longitudinal placement, the four-cycle engine and suction devices attached to the engine can be compactly housed in said small space while realizing favorable positional relationships in a substantially integrated manner.

2) Since the four-cycle engine can be mounted in such a manner that a crank shaft is positioned at a substantially center position in the width direction of the hull, the weight of the engine is prevented from being extremely deviating to one of the left and right sides of the hull, thereby realizing a satisfactory weight balance as a whole.

3) In consideration of the facts that the space for housing the engine is prolonged in the longitudinal direction of the hull and that exhaust gasses of an engine are preferably directed toward the aft side, the four-cycle engine and suction and exhaust devices can be adequately arranged in the hull without increasing the width of the hull and the like.

4) A plurality of exhaust pipes are integrally molded by casting so that at least the space between adjacent exhaust pipes can be eliminated and pipe walls of adjacent exhaust pipes are commonly used. Consequently, the width of each exhaust pipe is narrowed (contracted), and the exhaust pipes can be compactly configured with an engine. In addition to the above, all the exhaust pipes are formed equal in length to each other so that the output power of the engine can be stabilized.

5) The pair of gears can eliminate any inconvenience caused by the level difference which is often produced between the crank shaft of a four-cycle engine and a drive shaft of propulsion means, and matching of the revolution speed between the engine and the propulsion means can be attained. Consequently, the crank shaft and the drive shaft can be always connected to each other in a preferable state.

The other small jet boat having a four-cycle engine mounted in transverse placement can attain the following effects.

1) Since the four-cycle engine is mounted with directing the crank shaft in the transverse direction of the hull, suction devices which must be placed in positional relationships in a substantially integrated manner can be easily placed, for example, before or behind the cylinder arrangement plane. In other words, these devices and the like are not required to be disposed on the right or left side of the engine, and hence it is sufficient for the engine compartment to have a dimension at which the four-cycle engine can be transversely placed. Therefore, the width of the hull is not increased.

2) It is not necessary to shift the engine to one of the right and left sides of the hull in consideration of placement of suction devices. Accordingly, the four-cycle engine can be mounted at an adequate position also in the view point of weight balance.

3) Even though the crank shaft is directed in the transverse direction of the hull, the revolution of the crank shaft is smoothly transmitted to the propulsion means disposed aft by the function of the pair of bevel gears. Therefore, conventional means can be used as the propulsion means in a preferable manner.

4) All cylinders of the four-cycle engine are slanted so that the height of the engine which should be originally large is suppressed. Therefore, the height of the center of gravity of the whole of the small jet boat is reduced and the stability of the boat can be improved.

5) Suction or exhaust devices are placed above the engine which is reduced in height by slanting the cylinders. Consequently, the space which is required for the engine compartment can be shortened in the longitudinal direction of the hull.

6) Since suction devices are placed above the cylinders, etc. which are slanted to the aft side, the carburetor and the like can be easily placed above and near the cylinders. The passageways which elongate from the suction system to the cylinder head and from the cylinder head to the exhaust system on the rear side can be set in one direction from the fore side to the aft side so as to be simplified. Furthermore, gasses can pass through the passageways more smoothly.

7) The pair of gears including the pair of bevel gears, and the transmission shaft can eliminate any inconvenience caused by the level difference which is often produced between the crank shaft of a four-cycle engine and a drive shaft of propulsion means, and matching of the revolution speed between the engine and the propulsion means can be achieved. Consequently, the crank shaft and the drive shaft can be connected to each other in a satisfactory manner.

DETAILED DESCRIPTION OF PREFERRED EMBODIMENTS

Figure 1:
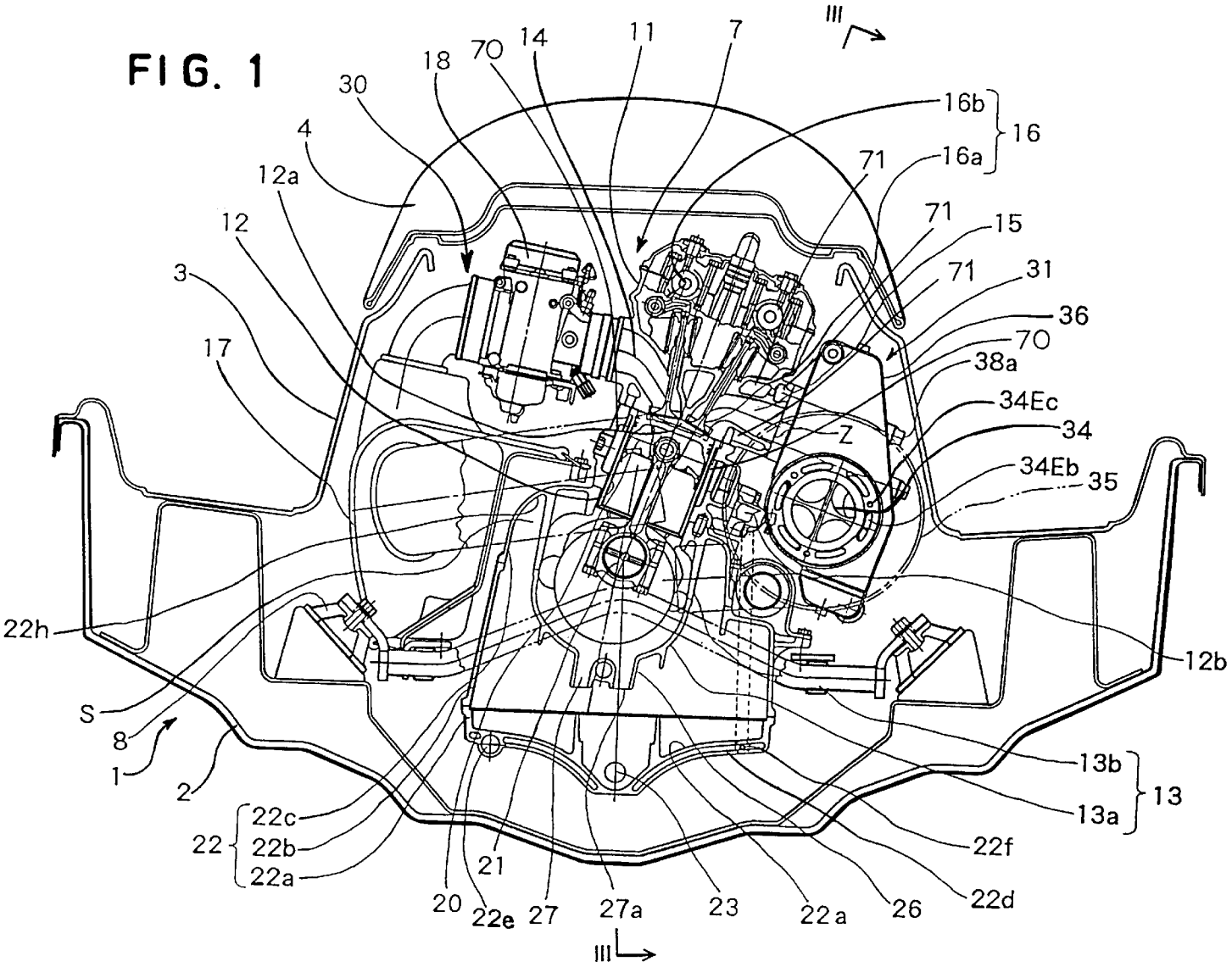
FIG. 1 is a cross sectional view showing a four-cycle engine which is a first embodiment of the invention.
Figure 2:
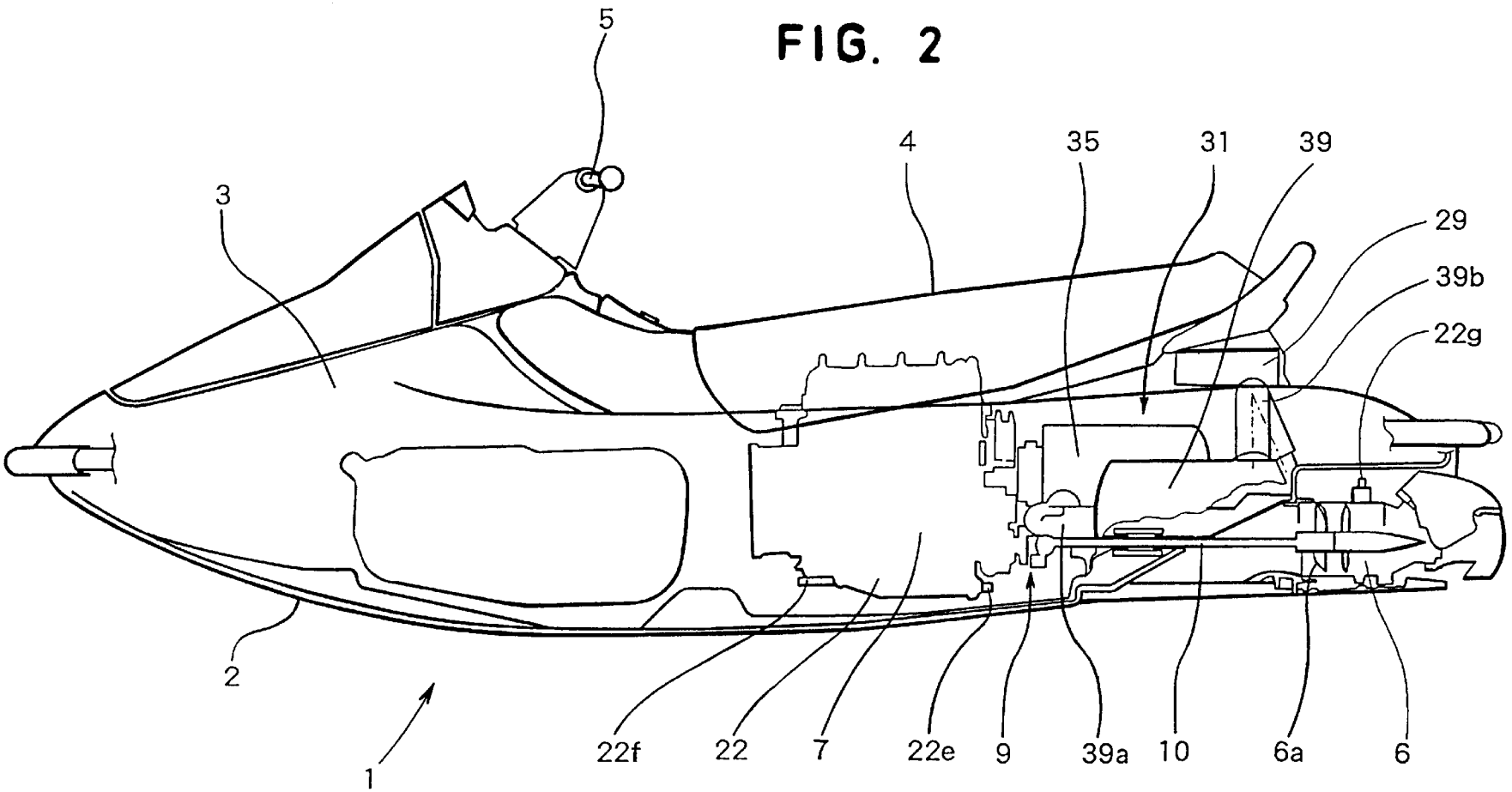
FIG. 2 is a fragmented side view of a small jet boat on which the four-cycle engine of FIG. 1 is mounted.

FIGS. 1 and 2 show a first embodiment of the invention. In the embodiment, a four-cycle engine 7 is mounted on a small jet boat 1. FIG. 1 is a cross sectional view of the small jet boat 1 and the four-cycle engine 7, and FIG. 2 is a side view of the small jet boat 1 with part of the shell plating of a hull fragment so as to show the engine 7, etc.

The small jet boat 1 is a watercraft with the main objective of leisure. As shown in FIG. 2, a hood 3, a seat 4, a handle 5, and the like are attached to the upper portion of a bottom hull 2 so that one or two persons go on board. The boat is propelled by a water jet which is pressurized and ejected by an impeller 6*a* of a water jet pump 6 disposed in a lower and rear portion, so the boat can glide over water. The impeller 6*a* is driven by the engine 7 which is mounted in a space surrounded by the bottom hull 2, the hood 3, the seat 4, and the like and at a substantially center position of the space in the longitudinal direction of the hull. The engine 7 is mounted on the bottom hull 2 via dampers 8 which use an elastic member such as a spring or rubber (see FIG. 1). The output of the engine 7 is transmitted via an elastic coupling 9 (FIG. 2 and FIG. 3) to a drive shaft 10 which rotates the impeller 6*a*.

The engine 7 is a four-cycle engine having four cylinders and is configured as shown in FIG. 1. The engine 7 comprises a cylinder head 11 at the upper portion, and with cylinders 12, a crankcase 13, and an oil pan 22 below the cylinder head. A suction port 14 and an exhaust port 15 are formed in the cylinder head 11. A valve operating mechanism 16 having a cam 16*b*, a timing chain 16*c* (FIG. 3), and valves 16*a* for closing and opening the ports 14 and 15 is mounted in the cylinder head. Ignition plugs 11*a* (FIG. 3) also are attached to the cylinder head. Suction devices 30 including an intake silencer 17 and a carburetor 18 are connected to a portion upstream from the suction port 14, and exhaust devices 31 including exhaust pipe 34 and a muffler 35 are connected to a portion downstream from the exhaust port 15. A piston 20 is placed inside each of the cylinders 12 so as to be slidable. A space defined by the cylinder, the piston, and the cylinder head 11 constitutes a combustion chamber 12*a*. The piston 20 is coupled with a crank shaft 21 which is supported via bearings 13*e* (FIG. 3) by the crankcase 13. An oil pan 22 in which lubricating oil is to be accumulated is hermetically attached below the crankcase 13 in such a manner that the crankcase 13 which extends downward is covered by the oil pan leaving a space as shown in FIG. 1. A cylindrical strainer 23 is placed in a lower portion recessed in the oil pan 22 and connected to a lubricating oil pressure pump (not shown) for conducting forced lubrication on various portions.

Figure 3:
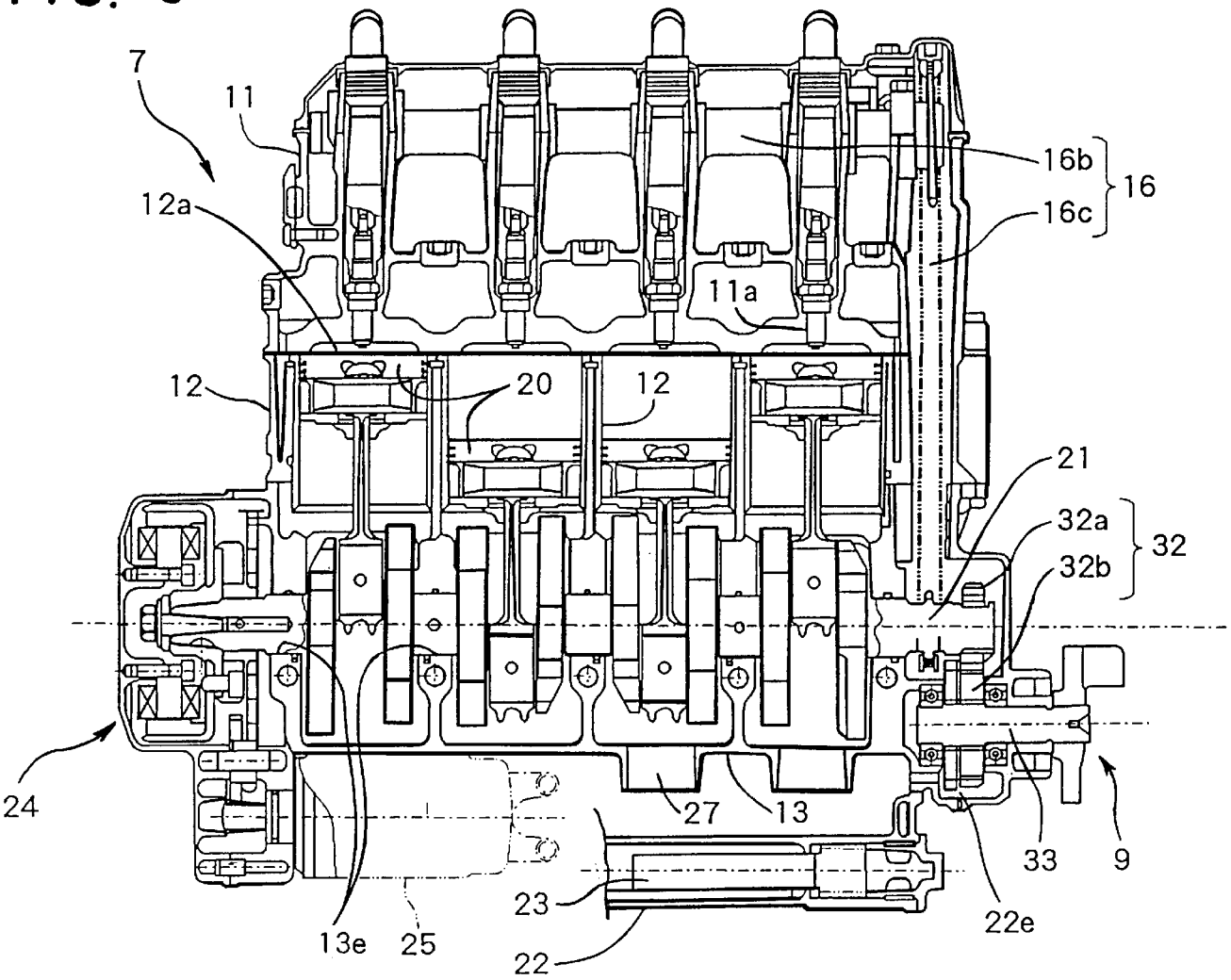
FIG. 3 is a longitudinal sectional view of the four-cycle engine mounted on the small jet boat, taken along line III—III of FIG. 1.

As shown in FIG. 3, a generator 24, a starter 25, and the like are connected to the crank shaft 21. The four-cycle engine 7 comprises and extends from the valve operating mechanism 16, and the like in the upper portion, to the oil pan 22 in the lower portion. Therefore, the height of the engine is considerably greater than that of a two-cycle engine. Since the engine is a four-cycle engine and the oil pan 22 is large in width, the engine also is considerably large in a horizontal direction.

The four-cycle engine 7 is unique in the configuration of the crankcase 13 and the oil pan 22. In a normal four-cycle engine, the bottom of a crankcase functions as an oil pan. In contrast, in the four-cycle engine 7, the oil pan 22 is disposed in such a manner that the oil pan 22 covers both the sides and the bottom of the crankcase 13 leaving a space as shown in FIG. 1. In other words, there is provided a configuration in which the crankcase 13 extends downward toward the inner space of the oil pan 22. A communicating hole 27 of a small diameter is disposed in the bottom of the crankcase 13. In this embodiment, the communicating hole, which may be a plurality of holes, is divided into two regions. A peripheral wall 26 is formed around the communicating hole 27 and protrudes downward. Lubricating oil which has been forcibly supplied to the sliding faces of the cylinders 12, the crank shaft 21, etc. drips onto the oil pan 22 via the communicating hole 27 and is then recovered. Further, the oil pan 22 is comprised of the bottom members 22*a*, the side members 22*b* and upper members 22*c*, while the crankcase 13 is comprised of the lower portion 13*a* and the upper portion 13*b*. The upper portion 13*b* of the crankcase and the upper member 22*c* of the oil pan also are formed integrally. The lower portions 13*a* of the crankcase and the side members 22*b* of the oil pan are formed integrally. As illustrated, the side members 22*b*, a part of the bottom member 22*a* and a part of the upper members 22*c* are hermetically joined so as to form the side wall of the oil pan 22. As illustrated in FIG. 1, the side wall of the oil pan 22 is separated from the communicating hole 27 by a large distance, and the distance between the upper end 22*h* of the side wall and the lower end 27*a* of the communicating hole 27 (the lower end of the peripheral wall 26) is considerably large, with the result that a space S of a sufficiently large capacity in both right and left sides of the crank case 13 is formed between the side wall and the crankcase 13.

Although the four-cycle engine 7 employs the wetsump system in which lubricating oil is accumulated in the engine, there is a small possibility that oil accumulated in the oil pan 22 enters the combustion chamber 12*a* even when the small jet boat 1 overturns so that the engine 7 is in a lateral turnover or inversion state. Specifically, when the engine 7 overturns laterally or upside down, lubricating oil accumulated in the lower portion of the inner space of the oil pan 22 moves to the inside or the upper portion of the side wall of the oil pan 22, and is then accumulated in the space S of a large capacity which is farmed between the side wall of the oil pan 22 and the communicating hole 27. Therefore, the lubricating oil is prevented from entering the inner space of the crankcase 13 via the communicating hole 27. In other words, since the portions of the side wall of the oil pan 22 are spacially separated from the communicating hole 27 by a sufficiently large distance and the distance between the upper end 22*h* of the side wall of the oil pan 22 and the communicating hole 27 is considerably large, lubricating oil exists only outside the crank case 13 whenever the engine is on the way to turning over or is in a turnover state. Since lubricating oil does not enter the inside of the crank case 13, the oil does not reach the inner space of the combustion chamber 12*a* via a gap between the cylinder 12 and the piston 20. Depending on the manner of turnover of the small jet boat 1, there is a possibility that splashed oil reaches the inner space via the communicating hole 27, but the quantity of such splashed oil is very small.

In the four-cycle engine 7, the peripheral wall 26 disposed around the communicating hole 27 as shown in FIG. 1 is not essential. Also in the case where such a wall is not formed, when the engine overturns, lubricating oil is accumulated in the space S outside the crankcase 13 and hardly enters the communicating hole 27.

Figure 4A:
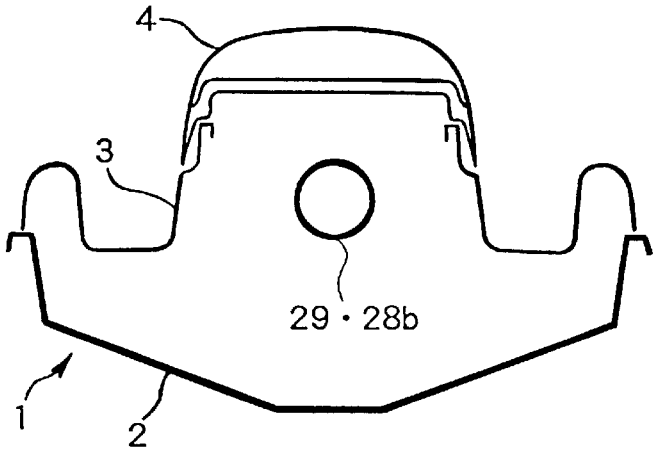
FIG. 4(*a*) is a cross sectional view of the small jet boat and showing the location of a turnover switch, FIG. 4(*b*) is a schematic circuit diagram which shows the connection of the switch in an ignition device, and FIG. 4(*c*) shows the construction of the turnover switch.
Figure 4B:
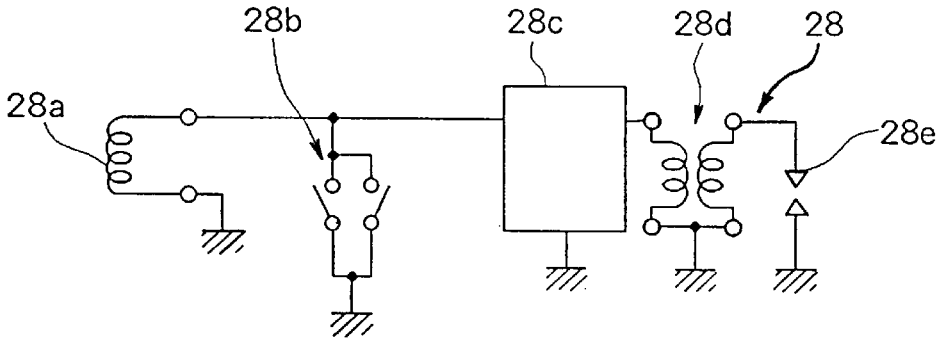
Figure 4C:
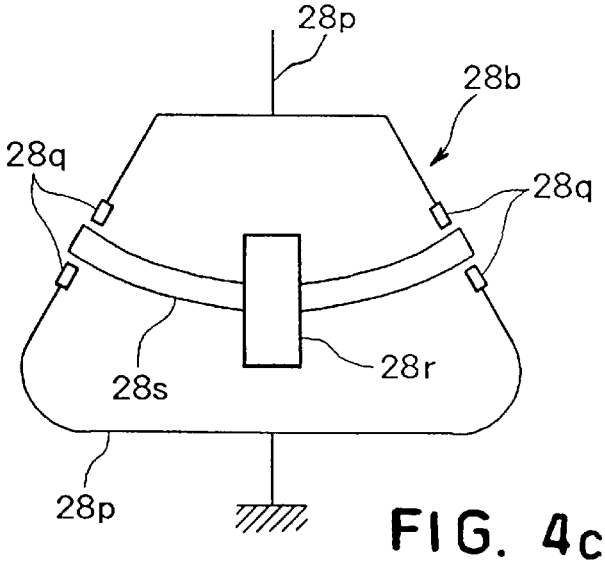

In order to automatically stop the engine 7 when the small jet boat 1 overturns, the boat is provided with a turnover switch 28*b* as shown in FIGS. 4(*a*) to 4(*c*). The turnover switch 28*b* is placed as shown in FIG. 4(*a*) and FIG. 2 in an electrical equipment housing box 29 (a hermetically sealed box which has sufficient waterproofness in order to house electrical equipment and other parts requiring water protection), and directly connected to an ignition device 28 of the engine 7 as shown in FIG. 4(*b*). In FIG. 4(*b*), the reference numerals 28*a*, 28*c*, 28*d*, and 28*e* designate an exciter coil, a CDI unit, an ignition coil, and an ignition plug which constitute the ignition device 28, respectively. A weight switch shown in FIG. 4(*c*) is used as the turnover switch 28*b*. Specifically, two normally open contacts 28*q* are connected to a circuit formed by wires 28*p* which are grounded at one end. The contacts are disposed for the left and right sides (the transverse direction of the hull) in a transversely symmetrical manner, respectively. A weight 28*r* is placed so as to be movable along a U-like rail 28*s* which lies between the contacts 28*q*. When the rail 28*s* is slanted to either of the left and right sides by a predetermined angle (e.g., 60 degree) or more, the weight 28*r* moves to contact with one of the contacts 28*q*, thereby closing the contact. This causes the output of the exciter coil 28*a* of the ignition device 28 to be grounded, so that the engine 7 is stopped. According to this configuration, when the small jet boat 1 overturns laterally or upside down, the engine 7 including the lubricating oil pressure pump(not shown in Figures), etc. is immediately stopped and hence also the oil supply to the crank shaft 21, etc. of FIG. 1 is stopped. As a result, there is no oil which is directly supplied to the inside of the crankcase 13 without passing through the communicating hole 27. This is further preferable for blocking lubricating oil from entering the combustion chamber 12*a*. If desired a turnover switch of another kind may be used. In place of the switch which, when grounded, turns off the engine 7, a switch of the type which, when grounded, turns on the engine may be used.

As shown in FIG. 1, a water jacket 22*d* through which cooling water passes is formed in the bottom member 22*a* of the oil pan 22 of the engine 7. Water which is taken through an intake opening 22*g* in a higher pressure zone of the water jet pump 6 shown in FIG. 2 passes through the inner space of the water jacket 22*d*. Specifically, a coupler 22*e* (FIG. 1 and FIG. 2) of the water jacket 22*d* (FIG. 1) is connected to an intake opening 22*g* (FIG. 2) via a tube (not shown), and another coupler 22*f* (FIG. 1 or 2) is similarly connected to a coupler 12*b* (FIG. 1) for cooling water of the cylinder 12 (FIG. 1) via a tube. According to this configuration, water taken from the water jet pump 6 (FIG. 2) cools the oil pan 22 (FIG. 1) in addition to the cylinder 12 (FIG. 1) and the cylinder head 11 (FIG. 1). As shown in FIG. 1, cylinder 12 is cooled by cylinder water jacket 70 and cylinder head 11 is cooled by cylinder head water jacket 71. As shown in FIG. 2, the engine 7 is placed in the enclosed space(the engine compartment) surrounded by the bottom hull 2 and the hood 3, and hence cannot be air-cooled even when the boat glides over water. In spite of the above, the engine can be adequately cooled by the water-cooling structure described above.

The small jet boat 1 shown in FIG. 2 includes the four-cycle engine 7 which is large in size and weight and is mounted in the hull as shown in FIG. 2. When the four-cycle engine 7 is to be mounted in the hull of the small jet boat 1 which has a limited capacity, the following problems must be solved.

(1) As compared with a two-cycle engine which is usually used, the head part of the four-cycle engine 7 is considerably larger. Therefore, it is difficult to adequately mount the suction devices 30 in the hull, which should be mounted adjacent to the cylinder head.

(2) Since the four-cycle engine 7 is heavy, the weight distribution in the small jet boat 1 must be considered so as not be deviated toward one of the right and left sides of the hull.

(3) Since a crank shaft of a four cycle engine is generally located at a rather higher level from the bottom of the engine in comparison with the location of a crank shaft of a two cycle engine, it is difficult to connect the crank shaft 21 to the drive shaft 10 of the water jet pump 6 which must be disposed in the vicinity of the bottom of the hull.

In the small jet boat 1, the problems are solved by employing the following layout.

In order to solve problems (1) and (2), the four-cycle engine 7, the suction devices 30, and the like are placed in the hull as shown in FIG. 1. Namely, the four-cycle engine 7 is disposed in such a manner that the crank shaft 21 of said engine is orientated in the longitudinal direction (in other words, longitudinally placed) of the hull, and the crank shaft 21 is positioned at a substantially center position with respect to the width of the hull, and all the cylinders 12 of the four-cycle engine 7 are slanted to the right side of the hull as viewed toward the fore side. The suction devices 30 are placed on the left side which is opposite to the slanted side. The water jacket housing 36 which houses the exhaust pipe 34 is placed in the space on the right side. As shown in FIG. 2, the muffler 35 and the like are disposed at a position of the hull which is more rearward than the four-cycle engine 7.

In this layout, the four-cycle engine 7, etc. can be adequately placed in the small space in the hull while solving problems (1) and (2).

First, since all four cylinders 12 which extend upwardly from the crank shaft 21 are slanted to the right side of the hull as shown in FIG. 1, it is possible to provide a space in which the suction devices 30 can be placed, in the side opposite to the slanted side.

Second, since the suction devices 30 are placed in the side opposite to the slanted side and corresponding to an obliquely upper position with respect to the cylinders 12, it is easy to dispose the carburetor 18, etc. above and near the cylinders 12.

Third, even though the cylinders 12 are gathered to the right side of the hull, the crank shaft 21 is positioned substantially at the center of the hull width. Consequently, the deviation of the weight of the engine 7 toward the right side is so small that the deviation can be corrected by adequately placing the suction devices 30, etc., thereby allowing the center of gravity of the whole of the boat to be positioned at the center of the width of the hull.

Fourth, the exhaust pipe 34 which may be placed regardless of its level relative to the engine 7, can be compactly formed in the narrow space positioned at the right side of the engine 7 without reducing the efficiency of the engine. Even when the hull has a small width, therefore, the exhaust pipe 34 can be placed without problems.

Fifth, since the space in the hull is extended in the longitudinal direction, the engine 7 and the like can be easily placed at an adequate position in the longitudinal direction determined by considering the installation space, the weight distribution, etc.

FIGS. 5 to 9 illustrate the exhaust pipe 34 and the water jacket housing 36 containing the exhaust pipe 34.

Figures 5A, 5B:
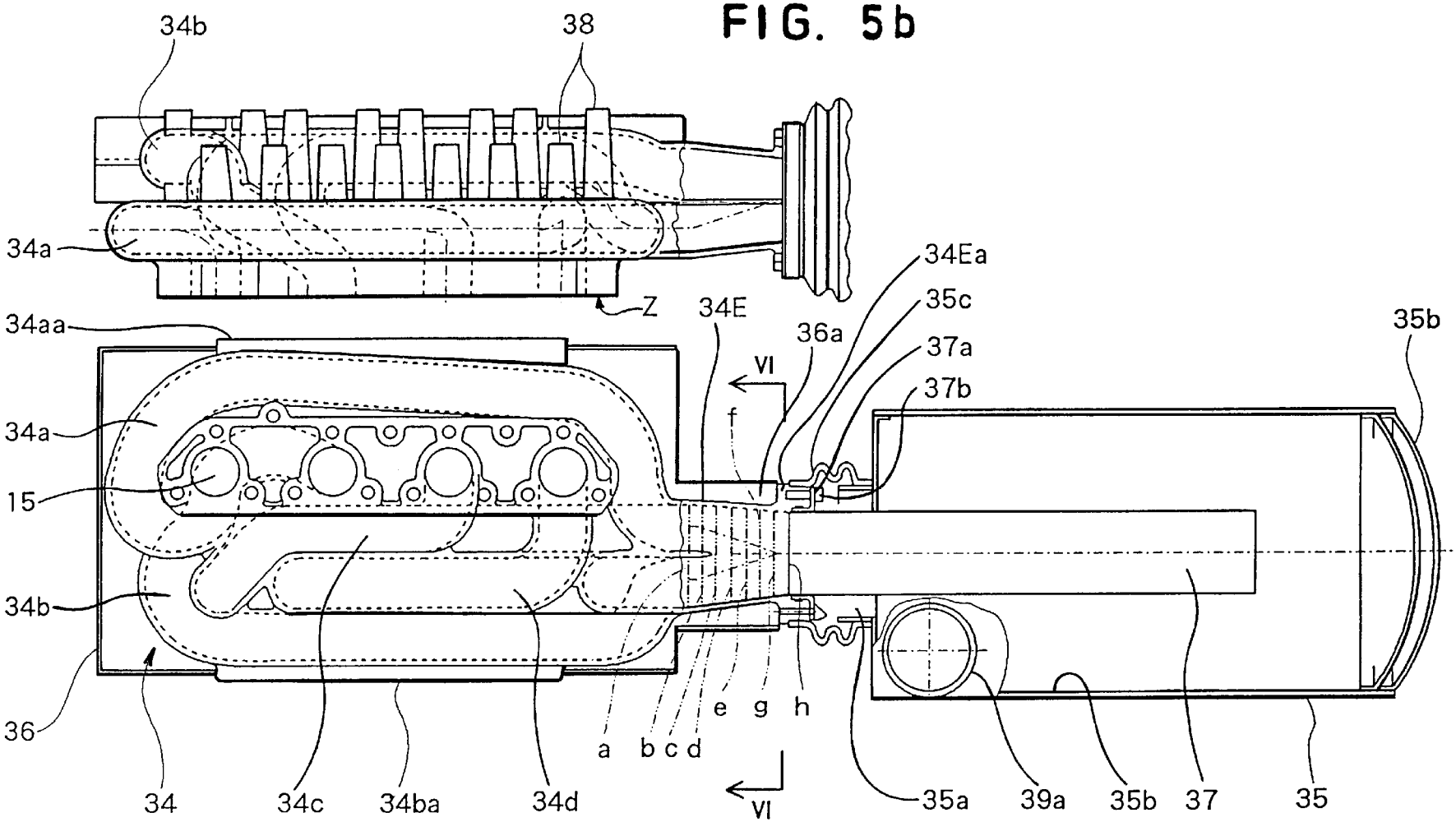
FIG. 5(*a*) is a fragmentary sectional view seen from the engine side showing exhaust pipes which are to be applied to the four-cycle engine of FIG. 1, and FIG. 5(*b*) is a plan view of the exhaust pipes of FIG. 5(*a*).

As shown in FIGS. 5 to 8, the exhaust pipe 34 is constructed with the exhaust pipes 34*a* to 34*d* respectively connected to exhaust ports 15*a* to 15*d* of the cylinder head. All four exhaust pipes 34*a* to 34*d* are made substantially equal in length to each other. The end portions of the exhaust pipes 34*a* to 34*d* are gradually combined into a common exhaust outlet portion 34E, and all the exhaust pipes 34*a* to 34*d* are integrally molded by casting. FIG. 5(*a*) shows the fragmentary sectional view of the exhausting system and FIG. 5(*b*) shows the plan view of the exhausting system seen from the engine side. Specifically, all four exhaust pipes 34*a* to 34*d* including the common exhaust outlet portion 34E at the rear end are integrally molded by casting in such a manner that the exhaust pipes 34*a* to 34*d* are first respectively elongated from the corresponding exhaust ports 15*a* to 15*d* in a direction (forward) which is opposite to the direction of the common exhaust outlet portion 34E at the rear end, then gently bent to gradually change the directions of the exhaust pipes to the direction (rearward) of the common exhaust outlet portion 34E, and thereafter elongated into a linear form in parallel with the series of the cylinders of the engine 7, and the end portions of the exhaust pipes 34*a* to 34*d* are disposed so as to be vertically and horizontally symmetrical with respect to the center point 0 (see FIG. 6) of the common exhaust outlet portion 34E.

The exhaust pipe 34 is illustrated more specifically in FIGS. 8(*a*) to 8(*d*). FIG. 8(*a*) to FIG. 8(*d*) each shows the fragmentary sectional view of the exhaust pipes seen from the engine side in the lower part thereof and shows the plan view of the exhaust pipes in the upper part thereof. As shown in FIG. 8(*a*), the exhaust pipe 34*a* connected to the foremost exhaust port 15*a* is gently bent at a position in the vicinity of a mounting surface Z of the pipe 34 to the engine 7 (FIG. 1) from the exhaust port 15*a* to a downward direction to a forward direction and to an upward direction such as in a J-like shape. The exhaust pipe 34*a* is then elongated linearly above the four exhaust ports 15*a* to 15*d* toward the rearward direction, and gently bent in a downward direction at a position immediately rear side of the rearmost exhaust port 15*d*, and gently bent in a rearward direction at a position immediately below the exhaust port 15*d* so as to be gradually combined into the common exhaust outlet portion 34E.

As shown in FIG. 8(*b*), the exhaust pipe 34*b* connected to the second exhaust port 15*b* is elongated so as to be separated from the mounting surface Z, and gently bent at a separated position to a forward and to a downward position. The exhaust pipe 34*b* is linearly elongated at the lowest position of the other exhaust pipes 34*a*, 34*c* and 34*d* in a rearward direction, gently bent at a position after the rearmost exhaust port 15*d* in a slightly upward direction, and then gently bent in a rearward direction and elongated so as to be gradually combined into the common exhaust outlet portion 34E.

As shown in FIG. 8(*c*), the exhaust pipe 34*c* connected to the third exhaust port 15*c* is forwardly elongated so as to pass a position immediately below the exhaust port 15*c* in the vicinity of the mounting surface Z, bent so as to be separated from the mounting surface Z, and linearly elongated in a rearward direction at a separated position and gradually combined into the common exhaust outlet portion 34E.

As shown in FIG. 8(*d*), the exhaust pipe 34*d* connected to the rearmost exhaust port 15*d* is forwardly elongated so as to pass a position immediately below the exhaust pipe 34*c* at a position in the vicinity of the mounting surface Z, then bent so as to be separated from the mounting surface Z, and linearly elongated at a separated position in a rearward direction, and bent so as to approach the mounting surface Z, and linearly elongated at an approached position in a rearward direction so as to be gradually combined into the common exhaust outlet portion 34E.

In all the exhaust pipes 34*a* to 34*d* having the configuration described above, the lengths of their portions elongating from the connecting position to the corresponding exhaust ports 15*a* to 15*d* to the end portion of the common exhaust outlet portion 34E are substantially equal to each other. The exhaust pipes 34*a* to 34*d* and the exhaust outlet portion 34E are integrally molded by casting of aluminum alloy.

Figures 7A, 7B, 7C, 7D, 7E, 7F, 7G, 7H:
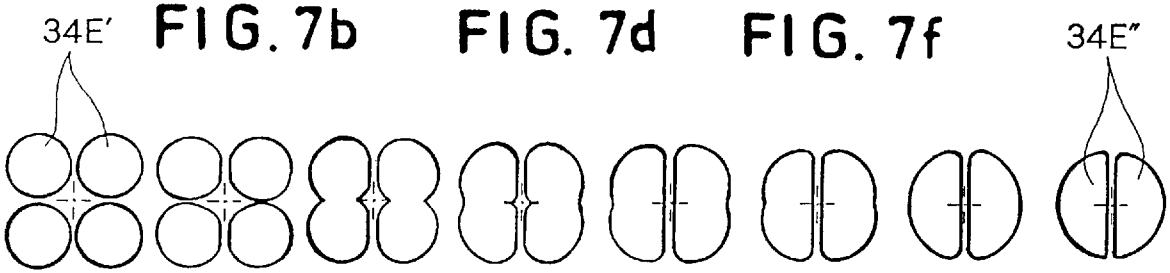
FIGS. 7(*a*)–(*h*) is a schematic view illustrating changes in the cross section of the exhaust pipes in the exhaust system of FIG. 5.
Figure 8A:
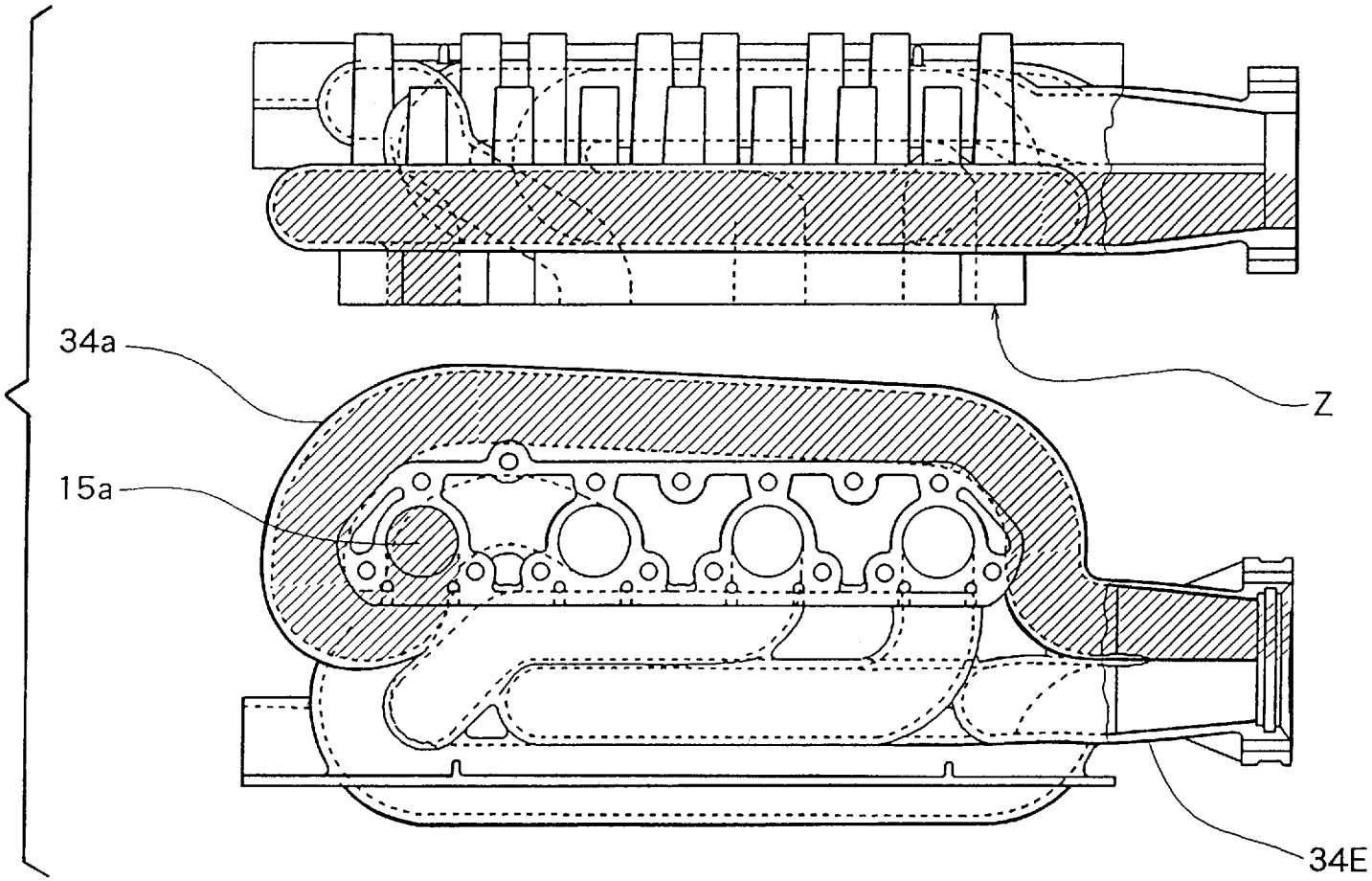
FIGS. 8(*a*)–(*d*) are respective views illustrating each exhaust path in the exhaust pipes in the exhaust system of FIG. 5.
Figure 8B:
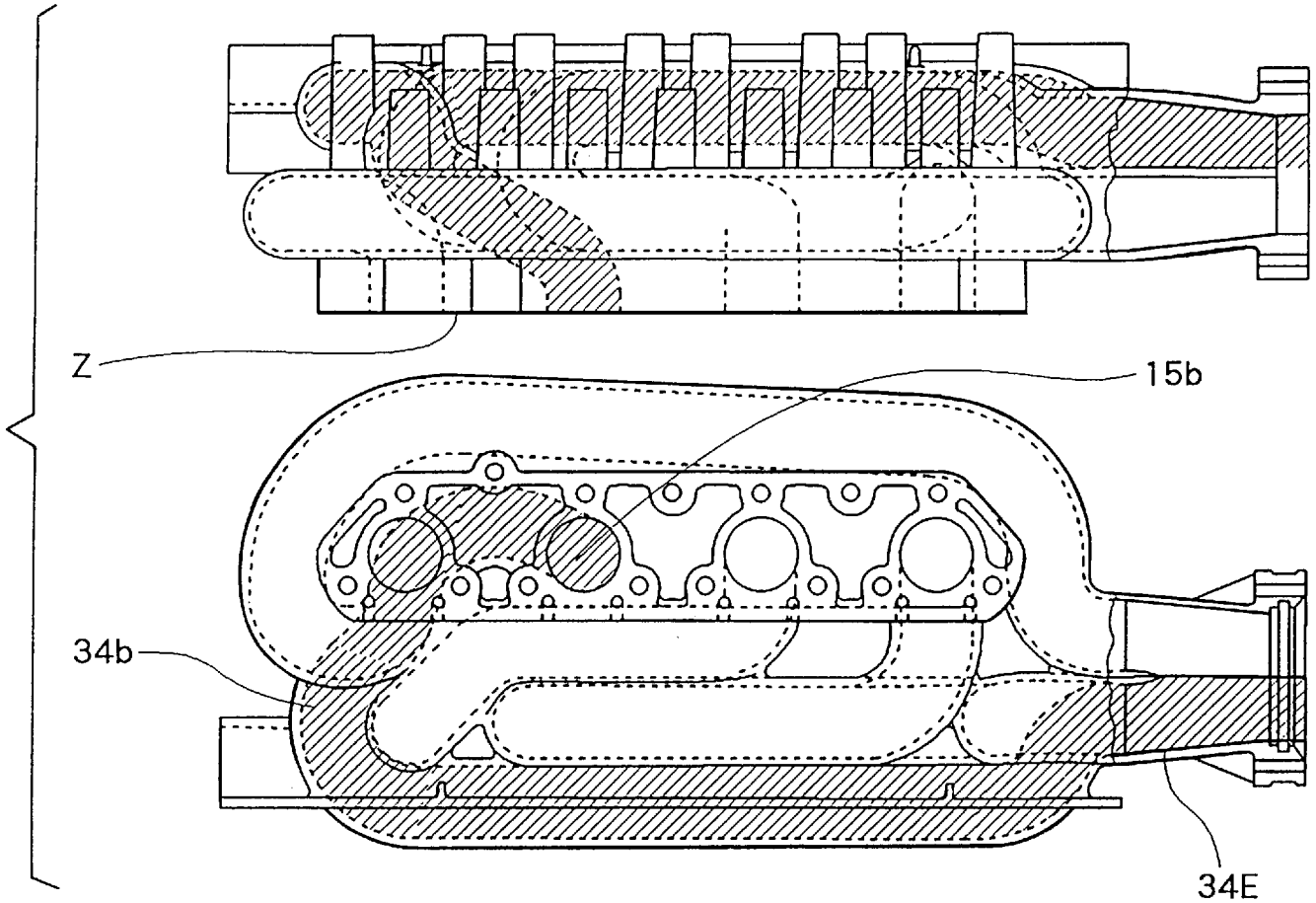
Figure 8C:
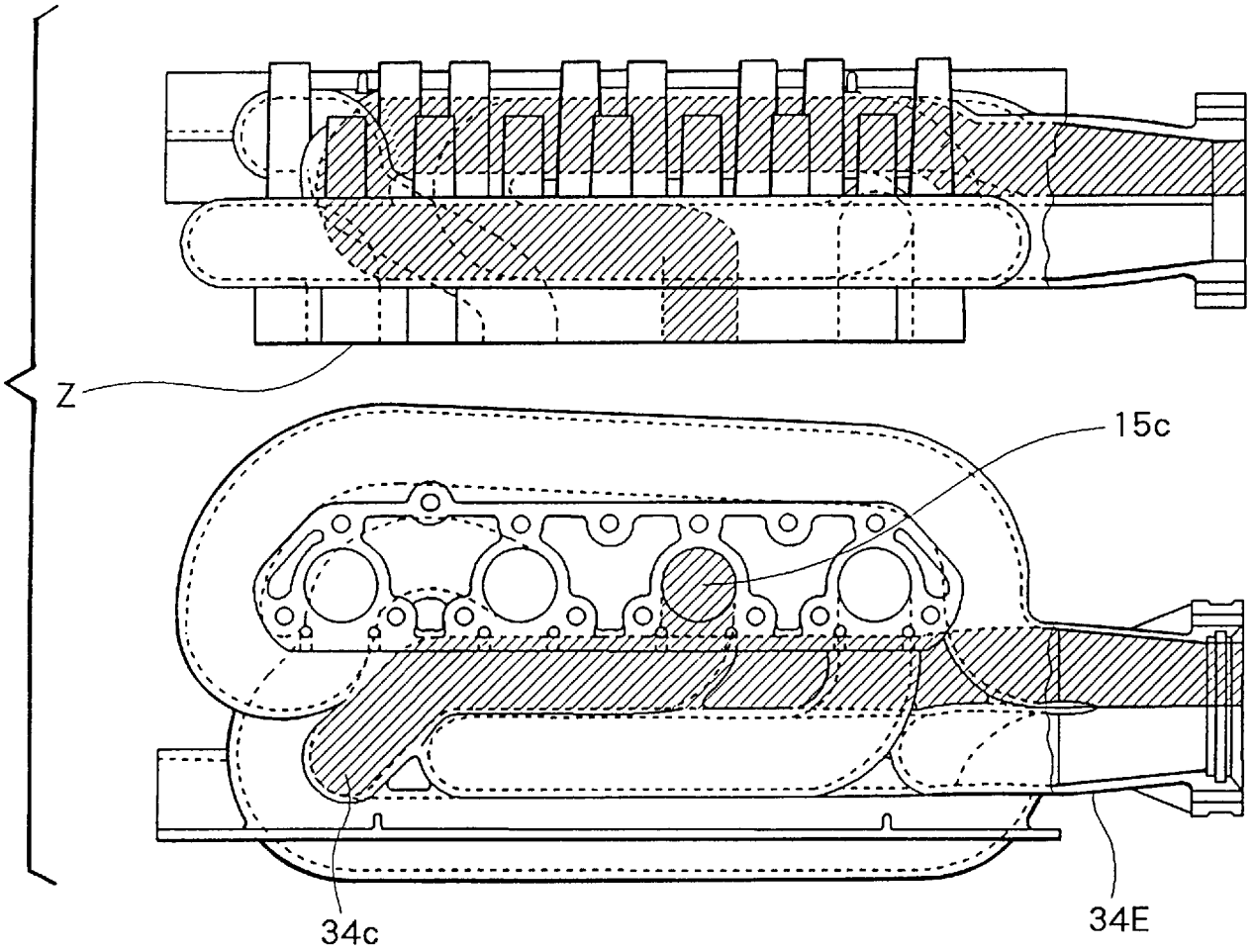
Figure 8D:
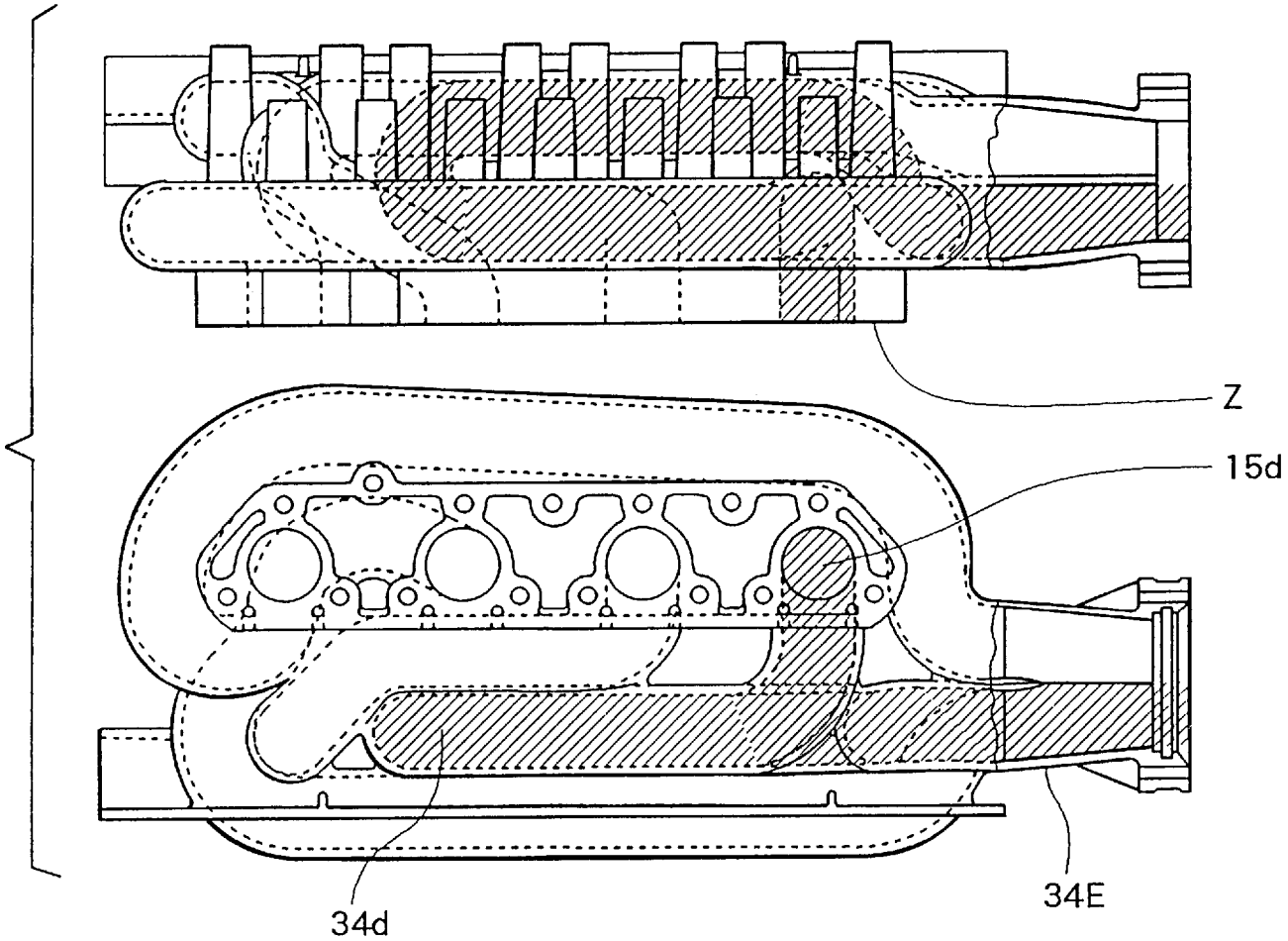

In the common exhaust outlet portion 34E, four circular exhaust outlets 34E' which are entirely independent from each other are formed as shown in FIG. 7(*a*), and the exhaust outlets 34E' are gradually combined into two common exhaust outlets vertically separated from each other as shown in FIGS. 7(*b*) to 7(*g*) so as to obtain two semicircular exhaust outlets 34E" at the rear end as shown in FIG. 7(*h*). A circular exhaust end pipe 37 is connected to the rear end of the exhaust outlet portion 34E as shown in FIG. 5(*a*).

Figure 6:
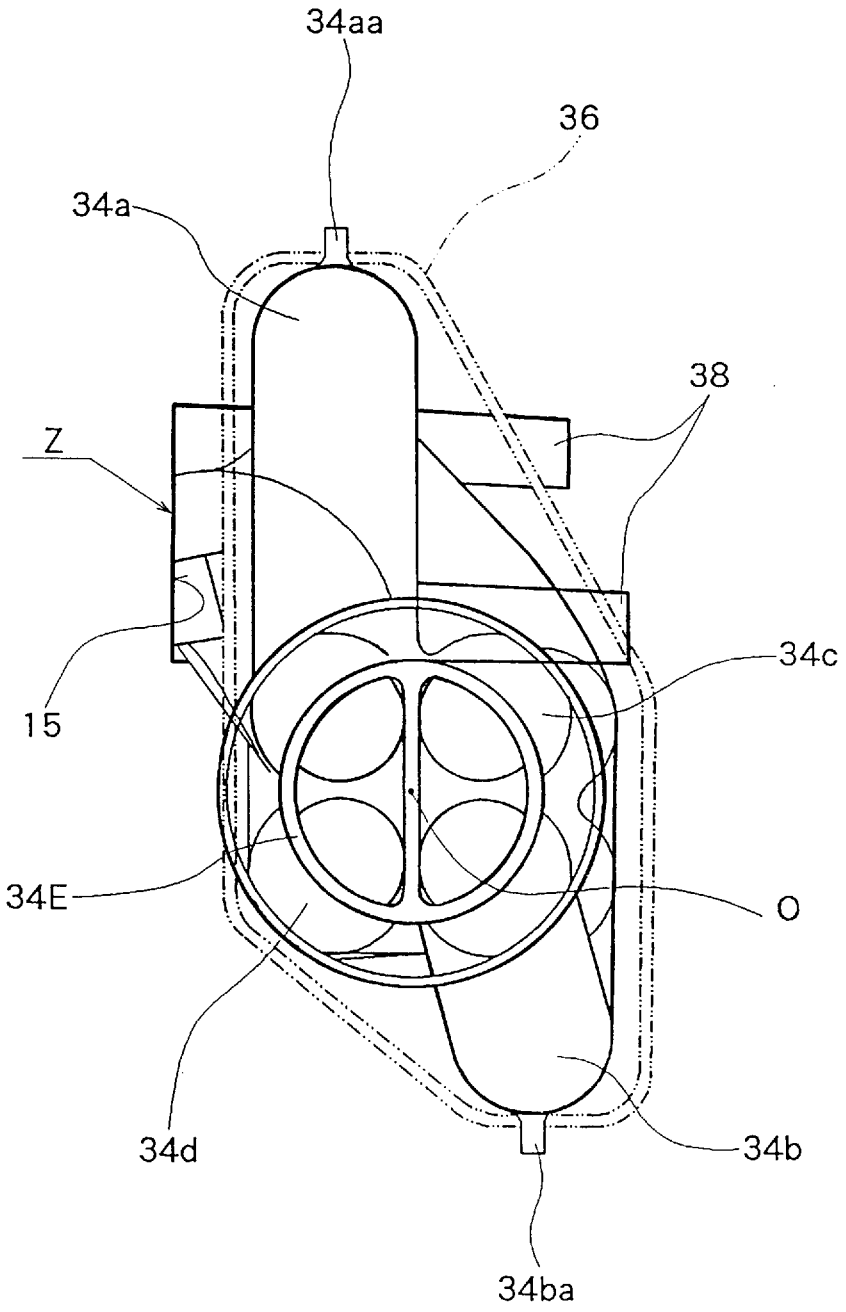
FIG. 6 is a fragmentary sectional view taken in the direction of the arrows substantially along the line VI—VI of FIG. 5.

The whole of the exhaust pipes 34*a* to 34*d* is surrounded by a water jacket housing 36, and cooling water is passed through the water jacket housing 36, thereby cooling the exhaust pipes 34*a* to 34*d*. Specifically, as shown in FIGS. 5 and 6, the water jacket housing 36 is mounted to cover the periphery of the exhaust pipes 34*a* to 34*d* and the exhaust outlet portion 34E which are integrally formed as described above. In the embodiment, as shown in FIG. 6, the water jacket housing 36 is made of an aluminum alloy plate formed into a substantially hexagonal section shape in which the opposing faces are approximately parallel to each other. Plate-like protrusions 34aa and 34ba extend from the linear portions of the exhaust pipes 34*a* and 34*b*. The upper and lower portions of the water jacket housing 36 are supported by the extensions 34aa and 34ba by means of welding. The water jacket housing 36 and the exhaust pipe 34 may be integrally molded together by casting. When the exhaust pipes 34*a* to 34*d* are integrally molded, a number of bosses 38 are formed to protrude from the exhaust pipe 34 as shown in FIG.5(*b*) and FIG. 6. The water jacket housing 36 and the exhaust pipe 34 are fixed to the cylinder head 11 by nuts 38*a* (FIG. 1 and FIG. 9) and suitable stud bolts(not shown in Figures) piercing through the bosses 38 (FIG.5). The rear portion of the water jacket housing 36 is formed into a cylindrical shape and its end is opened. The open end 36*a* is fittingly attached to the outer peripheral face of a rear end thick portion 34Ea of the exhaust outlet portion 34E. In the rear end thick portion 34Ea, as shown in FIG. 1, arcuate slots 34Eb are opened along the circumference at regular intervals, and threaded holes 34Ec are adequately formed between the slots 34Eb.

The exhaust end pipe 37 is attached to the rear end of the exhaust outlet portion 34E by screwing plural screws 37*b* which pass through a flange 37*a* integrally attached to the front end portion of the exhaust end pipe 37 as shown in FIG. 5(*a*), into the threaded holes 34Ec.

As shown in FIG. 5(*a*), an opening 35*a* which opens at the front end of a cylindrical muffler 35 is disposed so as to oppose the rear end of the exhaust outlet portion 34E. The muffler 35 is connected to the rear end thick portion 34EA of the exhaust outlet portion 34E by a bellows-like elastic ring 35*c* made from synthetic rubber. The rear end face of the muffler 35 is formed into a hemispherical face 35*b* which is rearwardly extending. The exhaust end pipe 37 is inserted into the center portion of the muffler 35. The muffler 35 is connected to the second muffler 39 placed at the side of the muffler 35(FIG.2) through a connecting pipe 39*a* connected to the lower portion of the front end of the muffler 35 (FIG.5). Although not illustrated, the inner space of the second muffler 39 is partitioned into a plurality of chambers, and cooling water is discharged together with exhaust gasses via an exhaust outlet pipe 39*b* which is inserted into the rear end of the second muffler 39. In the embodiment, cooling water which has passed through the water jacket 70 for the cylinders 12 and the water jacket 71 for the cylinder head 11 of the engine 7 flows into the water jacket housing 36, thereby cooling the exhaust pipes 34*a* to 34*d*. The cooling water of the water jacket housing 36 flows into the muffler 35 via the slots 34Eb, and also exhaust gasses from the exhaust end pipe 37 flows into the muffler. The cooling water and exhaust gasses which flow into the muffler 35 are sent to the second muffler 39 via the connecting pipe 39*a*, and then discharged to the outside via the exhaust outlet pipe 39*b*. Even when the small jet boat 1 laterally overturns and where cooling water flows into the muffler 35, the cooling water moves along the inner peripheral wall 35*d* of the muffler 35 so as to be situated at a location which is separated from the outlet of the exhaust end pipe 37, and hence the cooling water is prevented from flowing from the exhaust end pipe 37 into the exhaust pipes 34*a* to 34*d*, etc.

In the embodiment described above, the exhaust pipes 34*a* to 34*d* and the exhaust outlet portion 34E are integrally molded by casting out of an aluminum alloy and the water jacket housing 36 is integrally fixed to the exhaust pipes 34*a* to 34*d*. As a result, the exhaust pipes 34*a* to 34*d* and the water jacket housing 36 are caused to vibrate in an integral manner by vibration of the engine 7. In contrast, the muffler 35 is fixed together with the second muffler 39 onto the bottom hull 2. When the engine 7 is operated, therefore, the exhaust outlet portion 34E, the exhaust end pipe 37, and the like vibrate together with the water jacket housing 36 relative to the muffler 35. Therefore, the exhaust outlet portion 34E, the water jacket housing 36, exhaust end pipe 37 and the like are connected to the muffler 35 via the elastic ring 35C in order to prevent the vibration of the 34E, 36, 37 and the like from being transmitted to the muffler 35. In order to prevent the exhaust end pipe 37 from interfering with the muffler 35 when the exhaust end pipe 37 vibrates, the inner diameter of the opening 35*a* is made considerably greater than the outer diameter of the exhaust end pipe 37 as shown in FIG. 5(*a*).

Figure 9:
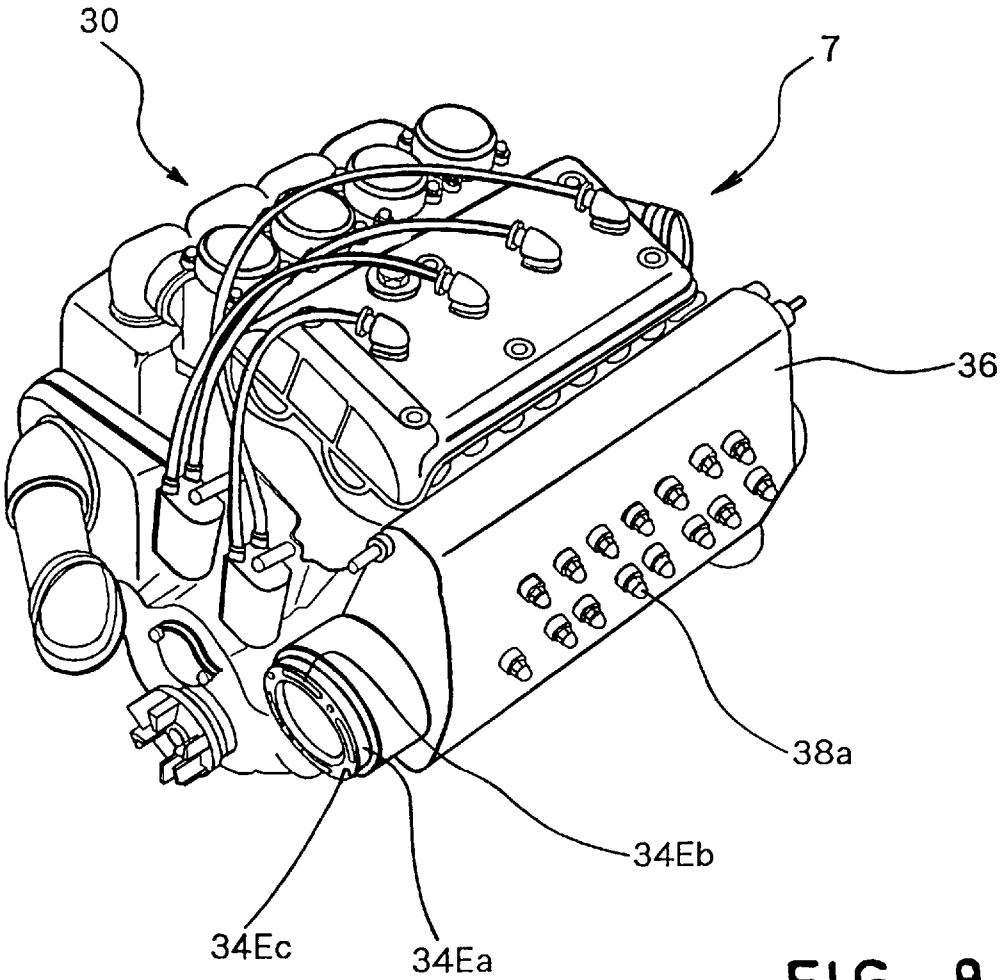
FIG. 9 is a perspective view illustrating the mounting status of the water jacket housing for the exhaust pipes of FIG. 5

In the small jet boat 1 having the above-described exhaust device, exhaust gasses from the exhaust ports 15*a* to 15*d* of the cylinder head of the four-cycle engine 7 are discharged into the muffler 35 via the respective exhaust pipes 34*a* to 34*d*, the exhaust outlet portion 34E, and the exhaust end pipe 37. At the same time, the exhaust pipes 34*a* to 34*d* are heated by the exhaust gasses of a high temperature passing therethrough. The cooling water from the water jacket of the engine 7 flows through the water jacket housing 36 to cool the exhaust pipes 34*a* to 34*d*, passes the periphery of the exhaust outlet portion 34E, and then flows into the muffler 35. As a result, the temperature rises of each exhaust pipes 34*a* to 34*d* and the exhaust outlet portion 34E are suppressed. Furthermore, the four-cycle engine 7 which is considerably larger in size than a two-cycle engine can be adequately disposed in the small engine compartment which is surrounded by shell plating of a hull. In other words, as shown in FIG. 9, the water jacket housing 36 is compactly formed so as to have an equal length as the engine 7 at axis of direction and said water jacket housing 36 is disposed adjacent to the engine 7. As described above, the space for placing the suction devices 30 can be secured by slanting all the cylinders 12 of the engine 7 in the same direction as the hull. Consequently, the four-cycle engine 7 and the suction devices 30 attached to the engine 7 can be compactly housed in the engine compartment while realizing favorable positional relationships in a substantially integrated manner. On the other hand, all the exhaust pipes 34*a* to 34*d* and the water jacket housing 36 can be housed in the smaller space on the side to which the engine 7 is slanted (the side opposite to the suction devices 30). Furthermore, not only the structure of the water jacket housing 36 but also the structure for connecting the housing to the muffler 35 can be simplified. Further, since each of the exhaust pipes 34*a* to 34*d* connected to the exhaust port 15 of the cylinder head 12 of the four-cycle engine can have a sufficient length, the inertia of the exhaust gas is effectively utilized and engine output will be efficiently progressed. In addition, since the four exhaust pipes 34*a* to 34*d* are almost equal in length to each other, the resistance against the exhaust gas of the four exhaust pipes 34*a* to 34*d* can be equal to each other. Further, each exhaust pipes 34*a* to 34*d* is constructed to be integrally formed gradually so that there is no exhaust interference, which enables the exhaust gas to flow smoothly and so that output loss hardly occurs.

In the above, the exhaust device of a four-cylinder engine has been described. The invention can be similarly applied to a four-cycle engine other than four cylinder engine as far as the engine to be mounted on the small jet boat 1 comprises a plurality of cylinders.

The embodiment described above can be applied to a drysump engine as well as a wetsump engine.

As described above, since the crankcase 13 and the oil pan 22 are configured into a kind of the double structure, the height from the bottom (installation plane) of the engine 7 to the crank shaft 21 is rather great. In the small jet boat 1, however, an output shaft 33 which is connected to the crank shaft 21 via a pair of gears 32 is disposed in the engine 7 as shown in FIG. 3.

According to this configuration, above-mentioned problem (3) is solved. The output shaft 33 is rotatably supported by the crankcase 13 and disposed below the crank shaft 21. A pinion 32*a* on the crank shaft 21 and a gear 32*b* on the output shaft 33 are engaged with each other so as to serve as the pair of gears 32. As shown in FIG. 2, the drive shaft 10 of the water jet pump 6 is connected to the output shaft 33 via an elastic coupling 9. Aside from the crank shaft 21, the output shaft 33 is disposed at a position which is nearer to the bottom of the engine 7, and hence the drive shaft 10 of the water jet pump 6 which must be placed in the vicinity of the bottom of the hull 2 can be connected to the output shaft 33 without substantially tilting the drive shaft 10. The pair of gears 32 is lubricated by a simple method such that the gear 32*b* is partly immersed in lubricating oil accumulated in an oil chamber 22*e* formed adjacent to one side end of the oil pan 22 of the engine 7 (see FIG. 3) of the wetsump system.

Furthermore, the pair of gears 32 has a gear ratio which can convert the rotational speed of the crank shaft 21 to that which is suitable for the water jet pump 6 for efficiency. This can achieve a favorable result for propulsion efficiency of the small jet boat 1. In other words, the output properties of the engine 7 can be suitably matched with the propulsion efficiency of the water jet pump 6 by means of the gear ratio of the pair of gears 32. This means that the employment of the pair of gears having an adequate gear ratio enables the four-cycle engines 7 of the same type to be mounted also on small jet boats respectively equipped with water jet pumps of different types having different propulsion performances, thereby promoting the common use of engines so as to realize the cost reduction of a small jet boat. It is a matter of course that the same effects can be attained also in the case where the pair of gears is disposed outside the engine 7.

Figures 10A, 10B:
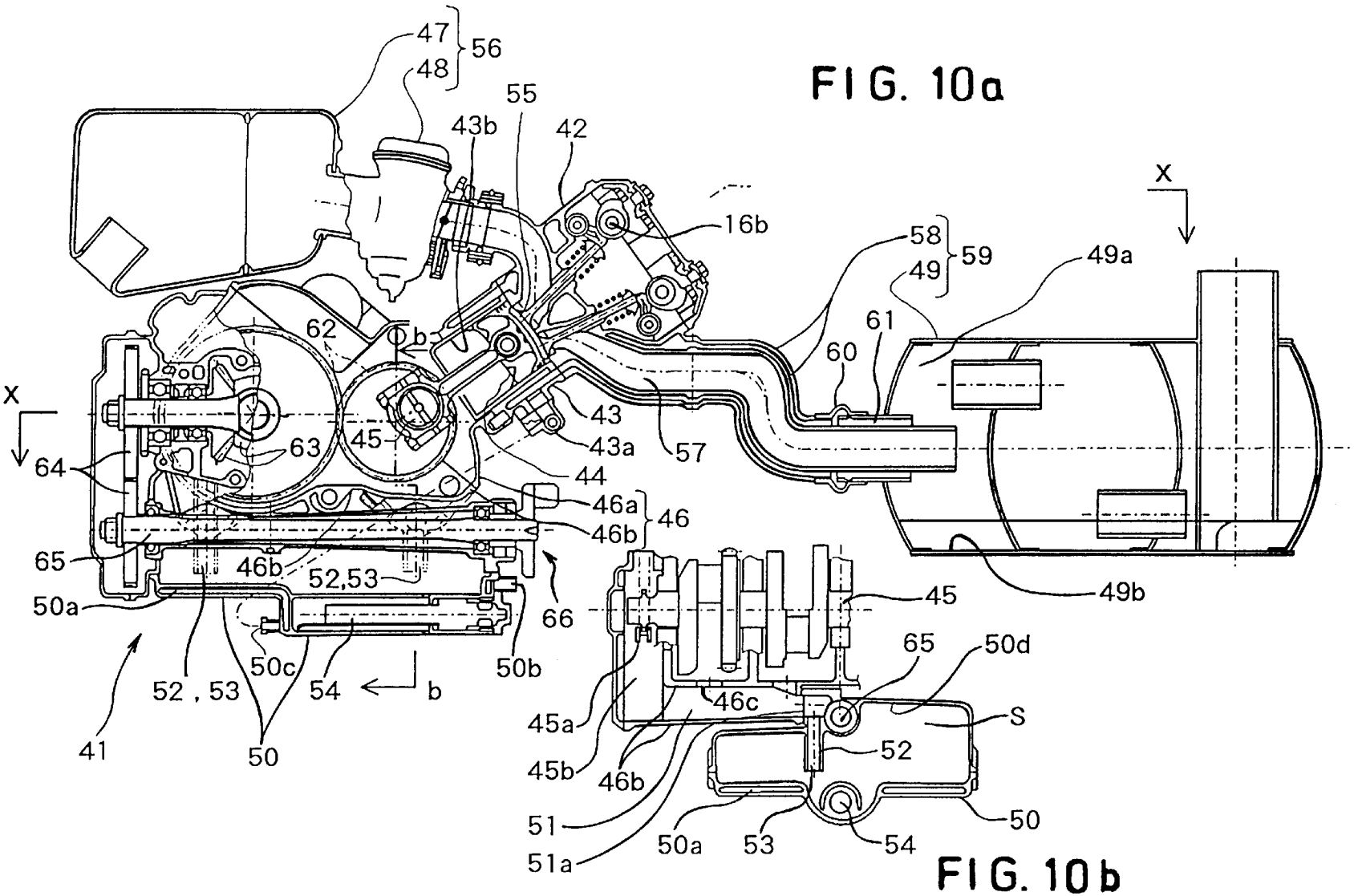
FIG. 10(*a*) is a cross sectional view showing the main portion of a four-cycle engine which is a second embodiment of the invention, and FIG. 10(*b*) is a sectional view taken along line b—b of FIG. 10(*a*).
Figure 11:
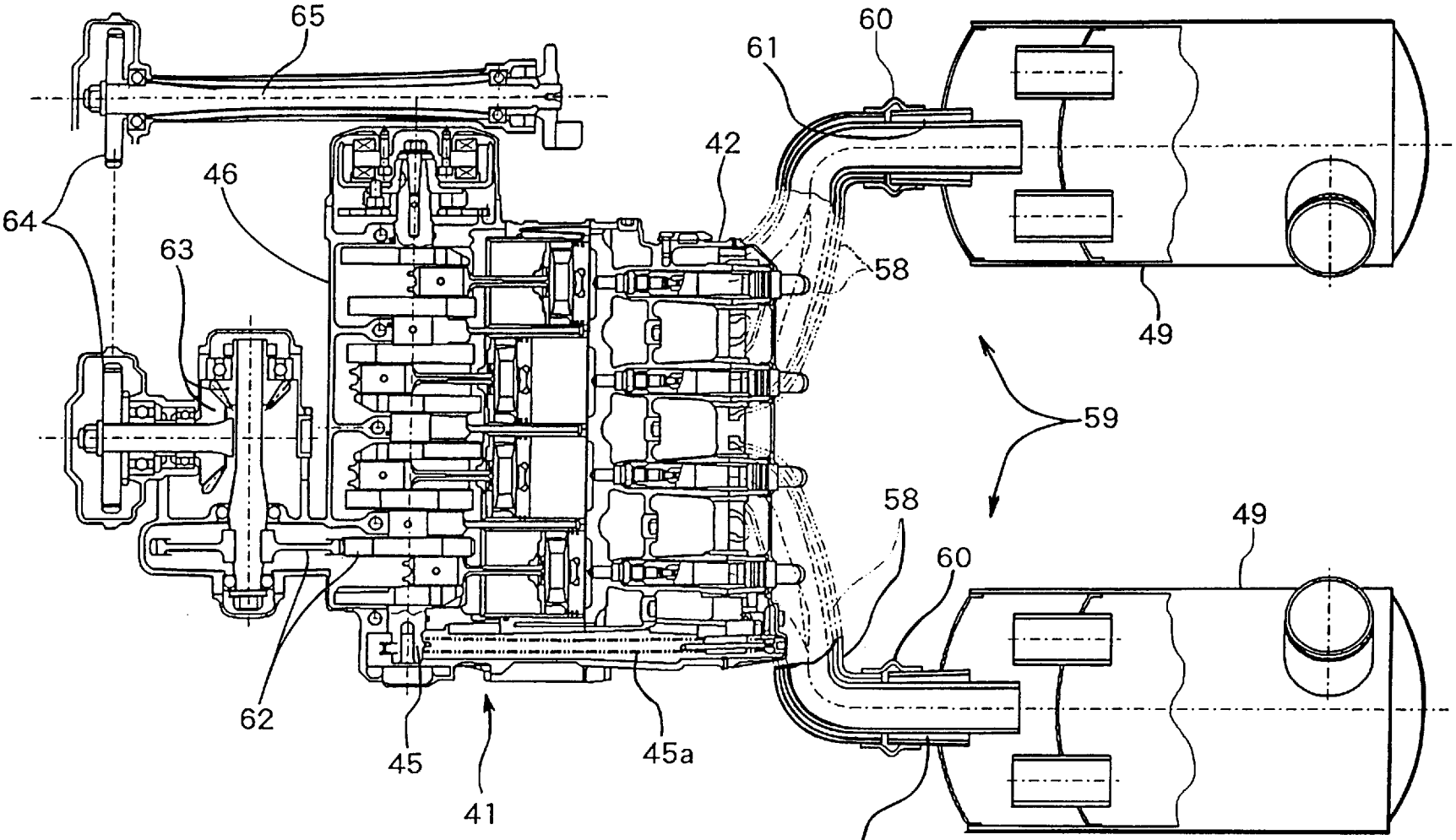
FIG. 11 is a plan view of the four-cycle engine, etc. taken along line IX—IX of FIG. 10(*a*) in which, for the sake of convenience, a transmission shaft and the like which are actually at a position immediately below the shaft are shown in the side.
Figure 12:
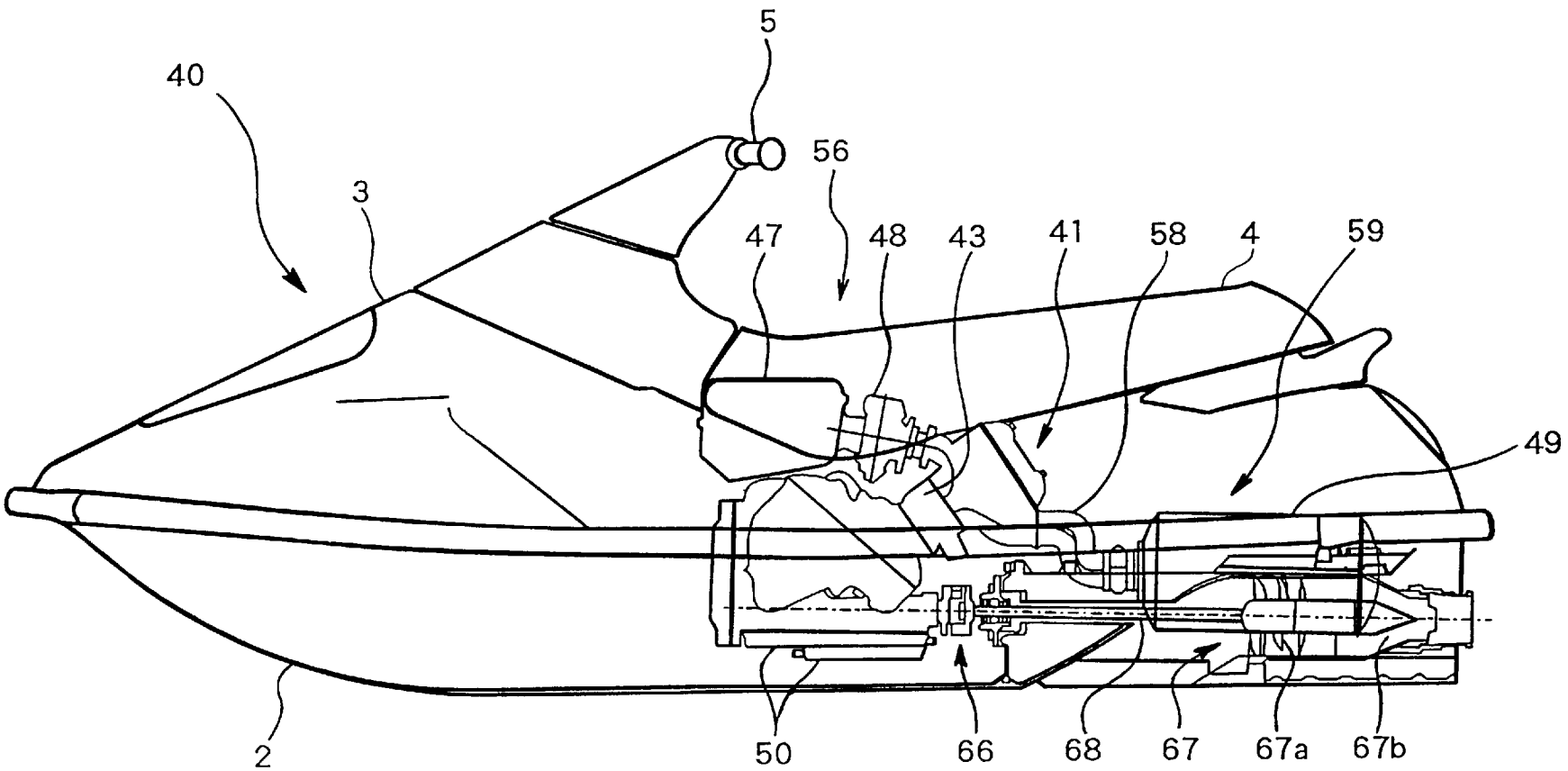
FIG. 12 is a fragmented side view showing a small jet boat on which the four-cycle engine of FIG. 10 is mounted.

FIGS. 10 to 12 show another embodiment (second embodiment) of the four-cycle engine and the small jet boat of the invention. FIG. 10(*a*) is a front view of a four-cylinder four-cycle engine 41. FIG. 10(*b*) is a sectional view taken along line b—b of FIG. 10(*a*), FIG. 11 is a plan sectional view (a sectional view taken along line IX—IX of FIG. 10(*a*)) of the four-cycle engine 41, etc., and FIG. 12 is a side view of a small jet boat 40 on which the four-cycle engine 41 is mounted (the engine 41, etc. are shown in a transparent state). The small jet boat 40 of FIG. 12 is configured in a manner similar to that of FIG. 2, and the description of identical components is omitted. The engine 41 of FIG. 10 is similar to the engine 7 of the first embodiment (FIG. 1) in that the engine 41 comprises a cylinder head 42, cylinders 43, pistons 44, a crank shaft 45, a crankcase 46, etc. and is connected to an intake silencer 47, a carburetor 48, and mufflers 49(FIG. 10 and FIG. 12). The crankcase 46 is formed with an upper case 46*a* and a lower case 46*b*.

However, the four-cycle engine 41 of FIG. 10 is somewhat different from the engine 7 of the first embodiment (FIG. 1) in the configuration of the crankcase 46 and an oil pan 50. In the engine 7 of FIG. 1, the bottom of the crankcase 13 swells toward the inner space of the oil pan 22. In contrast, in the engine 41, as shown in FIG. 10(*a*) and FIG. 10(*b*), the crankcase 46 is not located in the oil pan 50 and forms a space different from the inner space of the oil pan 50. Namely, an oil pan 50 containing a closed space is disposed outside of and below the upper case 46*a* and the lower case 46*b* of the crankcase 46. The upper case 46*a* and the lower case 46*b* are integrally coupled with each other by bolts, etc.(not shown) so as to form the crankcase 46. Further, a communicating path 51 which communicates the oil pan 50 and a tunnel 45*b* for a timing chain 45*a* is formed at the lower portion of the crankcase 46. The oil pan 50 is integrally coupled with the crankcase 46 at one end 51*a* of said communicating path 51 formed on the lower portion of the crankcase 46 as described above. The tunnel 45*b* is formed at a side end of the crankcase 46, namely, at the other end of the communicating path 51. The timing chain 45*a* is wound around the crank shaft 45 and a cam shaft(not shown) to drive cams 16*b* disposed on the cylinder head 42. A communicating hole 46*c* is formed at the bottom of crankcase 46, which is the lower case 46*b* of the crankcase 46, to communicate the inner space of the crankcase 46 with said communicating path 51. Two communicating pipes 52 projecting downwardly to the inner space of the oil pan 50 are formed, in this embodiment, on a top part of the oil pan 50, to communicate the inner space of the oil pan 50 with the communicating path 51. The two communicating pipes 52 are adjacent to the coupling point of the crankcase 46 with the oil pan 50, namely, adjacent to the end 51*a* of the communicating path.

Each communicating pipe 52 has a small diameter bored through the top part of the oil pan 50.

Since the communicating path 51 and the communicating pipes 52 etc. are constructed as described above, a lubricating oil which has been forcibly supplied to the sliding face of the cylinders 43, the crank shaft 45, etc. drips into the oil pan 50 through the tunnel 45*b* or the communicating hole 46*c*, then the communicating path 51 and the communicating pipes 52.

As illustrated in FIG. 10(*a*) and FIG. 10(*b*), a side wall of the oil pan 50 is separated from the communicating pipes 52 by a large distance, and the distance between the upper end 52*d* of the side wall and the lower end 52*a* of each communicating pipe 52 is large. As a result, a space S of a sufficiently large capacity around each communicating pipe 52 is formed between the side wall of the oil pan 50 and the communicating pipes 52.

The communicating pipes 52 can be formed on a bottom of the communicating path 51.

In the same manner as the first embodiment, a strainer 54 is placed in a lower portion recessed in the oil pan 50 and connected to a lubricating oil pressure pump (not shown).

Also the four-cycle engine 41 of FIG. 10 is lubricated by the so-called wetsump system. In the same manner as the engine 7 of the first embodiment (FIG. 1), the engine 41 has the advantage that, when the small jet boat 40 overturns, lubricating oil accumulated in the oil pan 50 essentially does not flow into a combustion chamber 55. Such flow is prevented from occurring even in the case of turnover because the large space S exists around and above the communicating pipes 52 in the oil pan 50. When the engine 41 laterally overturns or capsizes, lubricating oil is accumulated in the space S and scarcely reaches from the communicating pipes 52 to the inner space of the crankcase 46. Therefore, lubricating oil does not flow toward the combustion chamber 55 along the inner wall 43*b* of the cylinder 43.

In the space S, only the portion indicated in the left side of the communicating pipes 52 in FIG. 10(*b*) has a rather small capacity. When the engine 41 overturns toward the anti-clockwise direction, a small quantity of lubricating oil may return into the communicating path 51 via the communicating pipes 52. In such a case, however, there is no possibility that the oil reaches the combustion chamber 55, because of the following reasons.

First, the oil which reaches the communicating path 51 in the manner described above is not the whole of the oil in the oil pan 50 but only a small quantity.

Second, since a communicating hole 46*e* sized only for allowing lubricating oil to drip into oil pan 50 is formed at the bottom of the crankcase 46, when the engine 41 overturns to the above-mentioned side, oil which enters the communicating path from the communicating pipes 52 reaches a tunnel 45*b* (FIG. 10(*b*)) disposed for timing chain 45*a*. This essentially prevents the lubricating oil to enter the inner space of crankcase 46(FIG. 10(*a*)).

In the same manner as the first embodiment, a turnover switch (not shown) is disposed at any position of the small jet boat 40 and connected to the engine 41 so that, when the boat overturns, the engine 41 is automatically stopped. This is conducted so that the supply of lubricating oil to the inside of the crankcase 46 housing the crank shaft 45 of FIG. 10, etc. is halted by stopping the engine 41 including a lubricating oil pressure pump (not shown).

As shown in FIG. 10, a water jacket 50*a* is formed in the oil pan 50 of the engine 41 so that water which is taken from the higher pressure zone 67*b* of the water jet pump 67(FIG.12) passes through the inner space of the water jacket 50*a*. The reference numerals 50*b* and 50*c* in FIG. 10(*a*) designate couplers which lead to the water jacket 50*a* so that the water passes therethrough to reach a cooling water coupler 43*a* of the cylinders 43.

The small jet boat 40 of FIG. 12 is different from the first embodiment(FIG. 2) in the arrangement of the engine 41, etc. in the jet boat 40. In the first embodiment, the engine 7 is longitudinally placed as shown in FIG. 2, and the cylinders 12 are slanted to one side (to one lateral side of the boat 1) and the space for the suction devices 30 is secured at a location adjacent to the cylinders.

In contrast, as shown in FIGS. 10, 11, and 12 in the second embodiment, the engine 41 is transversely placed in the jet boat 40 (FIG. 12). That is, the crank shaft 45 is directed in the transverse direction of the hull and the cylinders 43 are arranged in the transverse direction, so as to be placed at a substantially center position in the width direction of the hull. All the cylinders 43 are largely slanted (about 55 degree) to the aft, and suction devices 56 such as the intake silencer 47 and the carburetor 48 are placed above the engine 41, i.e., in the space at a forward and obliquely upper position with respect to the cylinders 43. Exhaust devices 59 which are connected to a portion downstream from exhaust ports 57 of the cylinder head 42, such as exhaust pipes 58 and mufflers 49 are placed at a position of the hull which is more rearward than the engine 41.

Each outlet portion of the exhaust pipe 58 is inserted to a substantially center portion of a first chamber 49*a* of the muffler 49, and the exhaust pipe 58 of double structure is connected to the muffler 49 via a bellows-like rubber tube 60 to constitute a water jacket 61. Between the exhaust pipe 58 and the muffler 49, there is a gap in which the water jacket 61 can be formed. Even when the engine 41 supported by dampers(not shown in Figures) is displaced, therefore, the displacement is absorbed by the gap, thereby preventing the exhaust pipe 58 from contacting with the muffler 49. The outlet of the exhaust pipe 58 is positioned at a substantially center portion of the first chamber 49*a* of the muffler 49. Even when the small jet boat 40 overturns, therefore, water in the muffler 49 always remains in the vicinity of the inner wall 49*b* of the muffler 49 and there is no possibility that water enters the exhaust pipes 58. Water in the muffler 49 is discharged together with exhaust gasses to the outside of the hull via an outlet pipe(not shown in Figures).

In the second embodiment, as shown in FIG. 10, the output of the transversely placed engine 41 is taken out rearward from an output shaft 65 arranged perpendicularly with the crank shaft 45 at the lower part of said crank shaft 45 via a pair of spur gears 62, a pair of bevel gears 63, and a pair of spur gears 64, and then the output is transmitted via a coupling 66 to a drive shaft 68 of an impeller 67*a* of a water jet pump 67 as shown in FIG. 12.

In this layout, in the same manner as the first embodiment, the four-cycle engine 41 which is considerably larger than a two-cycle engine is housed in the limited space under the seat 4 of the small jet boat 40.

According to the layout described above, the four-cycle engine 41, etc. can be adequately placed in the small space in the hull while solving problems (1) and (2). The reasons of the above will be described with reference to FIG. 10.

First, the engine 41, and the suction devices 56 which must be placed near the cylinders 43 are not necessary to be placed adjacent to each other in the direction of the width of the hull which is particularly limited in size, and hence it is not necessary to increase the width of the hull.

Second, since the engine 41 is not required to be placed by being shifted to one of the right and left sides of the hull, the center of gravity of the whole can be positioned at the center of the width of the hull.

Third, since the space in the hull is extended in the longitudinal direction, the engine 41 and the like can be placed in a relatively easy manner at a position in the longitudinal direction which is determined in consideration of the installation space, the weight distribution, etc.

Fourth, since the cylinders 43 are largely slanted to the aft side and the suction devices 56 are placed in the space in the side opposite to the slanted side which is a forward and obliquely upper position with respect to the cylinders, the carburetor 48, etc. can be easily disposed at a position which is near and above the cylinders 43. Furthermore, the intake silencer 47 which has a large volume and a large length in the width direction of the hull can be placed in the engine room.

Fifth, since the cylinders 43 are slanted, the height of the center of gravity of the engine 41 is reduced. This is preferable in providing traveling stability of the boat.

Sixth, the exhaust devices 59 which may be placed at any position in vertical direction with respect to the engine 41 are disposed at a position which is in the aft side of the engine 41 and the suction device 56 which are disposed above the engine 41. Even when the hull has a small width, therefore, the exhaust devices can be placed without problems.

Seventh, paths for suction and exhaust (exhaust pipes 58, etc.) which elongate from the suction devices 56 disposed at a forward and obliquely upper position with respect to the cylinders 43, to the exhaust devices 59 disposed in a rear portion via the respective cylinders 43 can be set in simple passageways which are rather small in bending and small in flow resistance.

In the above, two embodiments of the four-cycle engine which are used in a small jet boat have been described. The four-cycle engine of the invention is not restricted to these two embodiments but may be preferably mounted, for example, on an off-road vehicle and any other machines which are used in the inclined situation.

What is claimed is:

1. A four-cycle engine comprising:

a crankcase having an interior portion and a bottom;

an oil pan for holding engine oil, said oil pan having a side wall and a side wall upper end, said oil pan defining an inner space and disposed below the crankcase so that a bottom of said crankcase projects toward the inner space of said oil pan;

a communicating hole formed in said bottom of said crankcase;

wherein said interior portion of said crankcase fluidly communicates with the inner space of said oil pan via the communicating hole, the oil accumulating in the oil pan, below the crankcase, when the engine is in an upright state; and said side wall of the oil pan, said side wall upper end, said crankcase, and said communicating hole defining a space operable to contain substantially all of the oil in the oil pan, below the communicating hole, when the engine is either overturned laterally or is upside down.

2. A four-cycle engine according to claim 1, including a peripheral wall projecting downward from said bottom of said crankcase toward said oil pan is formed around said communicating hole, said peripheral wall being separated from a side wall of said oil pan by a distance.

3. A four-cycle engine according to claim 1, including a switch for automatically stopping said engine when said engine is in a turnover state.

4. A four-cycle engine according to claims 1, wherein a water jacket for cooling is formed in said oil pan.

5. A small jet boat in which an engine driving a propulsion means is mounted in a space surrounded by shell plating of a hull, comprising:

four-cycle engine functioning as said engine mounted in such a manner that a crank shaft thereof is directed in a longitudinal direction of said hull and positioned at a substantially center position in a width direction of said hull;

said engine having a plurality of cylinders, all cylinders being slanted in a same direction and to one of left and right sides of said hull;

suction devices placed in a side opposite to the slanted side;

a water jacket for cooling formed in an oil pan of said engine;

a water jacket housing containing an exhaust pipe connected to an exhaust port of said engine; and a cooling water intake means disposed in a higher pressure zone of said propulsion means.

6. A small jet boat according to claim 5, wherein said four-cycle engine further comprises exhaust pipes respectively connected to exhaust ports of a cylinder head and wherein said exhaust pipes are substantially equal in length to each other at an exhaust port side of the engine, end portions of said exhaust pipes are gradually combined into a common exhaust outlet, and all of said exhaust pipes are integrally formed by casting and covered by said water jacket housing.

7. A small jet boat according to claim 6, wherein a whole of said exhaust pipes is surrounded by said water jacket housing, and cooling water is passed through said water jacket housing, thereby cooling said exhaust pipes.

8. A small jet boat according to claim 6, wherein said water jacket housing has a box-like shape.

9. A small jet boat according to claim 6, wherein said four-cycle engine is an in-line four-cylinder engine, all of said exhaust pipes at the exhaust port side of the engine are integrally formed such that four exhaust pipes are elongated from four respective exhaust ports in a direction opposite to a direction of said common exhaust outlet, gently bent to gradually change direction of said exhaust pipes towards said common exhaust outlet, and thereafter elongated into a linear form, and said end portions of said exhaust pipes are disposed so as to be vertically and horizontally symmetric with respect to a center point of said exhaust outlet, and a length of the exhaust pipes, not including the common exhaust outlet, is substantially equal to a length of said four-cycle engine.

10. A small jet boat according to claim 5, wherein a drive shaft of said propulsion means is connected to said crank shaft via a pair of gears.

11. A small jet boat according to claim 5, further comprising a cooling water route wherein cooling water is taken from the intake means and flows sequentially into: (1) the water jacket of the oil pan; (2) a cylinder water jacket; (3) a cylinder head water jacket; and (4) the exhaust pipe water jacket housing; and wherein the cooling water flows out of the exhaust pipe water jacket housing, is mixed with exhaust gases, and is discharged from the small jet boat.

12. A small jet boat according to claim 5, wherein said engine comprises:

a crankcase having an interior portion and a bottom;

an oil pan for holding engine oil, said oil pan having a side wall, said oil pan defining an inner space and disposed below the crankcase so that a bottom of said crankcase projects toward the inner space of said oil pan;

a communicating hole formed in said bottom of said crankcase;

wherein said interior portion of said crankcase fluidly communicates with the inner space of said oil pan via the communicating hole; and said side wall of the oil pan and said crankcase defining a space of sufficiently large capacity to contain all of the oil in the oil pan when the engine is in a lateral state or in a turnover state.

13. A small jet boat according to claim 12, wherein said engine further comprises a switch for automatically stopping said engine when said engine is in a turnover state.

14. A small jet boat in which an engine for driving a propulsion means is mounted in a space surrounded by shell plating of a hull, comprising:

a four-cycle engine functioning as said engine mounted in such a manner that a crank shaft thereof is directed in a longitudinal direction of said hull and positioned at a substantially center position in a width direction of said hull, all cylinders of said four-cycle engine slanted in a same direction and to one of left and right sides of said hull, and suction devices placed in a side opposite to the slanted side;

wherein said four-cycle engine is an in-line four-cylinder engine having exhaust ports and exhaust pipes, all of said exhaust pipes are integrally formed in such a manner that four exhaust pipes are first respectively elongated from said exhaust ports in a direction which is opposite to a direction of a common exhaust outlet, gently bent to gradually change directions of said exhaust pipes to the direction of said common exhaust outlet, and thereafter elongated into a linear form, and end portions of said exhaust pipes are disposed so as to be vertically and horizontally symmetric with respect to a center point of said exhaust outlet, and a length of a whole of said exhaust pipes which are integrally molded, except said common exhaust outlet is substantially equal to a length of said four-cycle engine.

15. A small jet boat according to claim 14, wherein a whole of said exhaust pipes is surrounded by a water jacket housing, and cooling water is passed through said water jacket housing, thereby cooling said exhaust pipes.

* * * * *